US007882790B2

(12) United States Patent
Kishi et al.

(10) Patent No.: US 7,882,790 B2
(45) Date of Patent: Feb. 8, 2011

(54) SEWING MACHINE

(75) Inventors: Motoshi Kishi, Nagoya (JP); Naomi Yamamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1046 days.

(21) Appl. No.: 11/698,861

(22) Filed: Jan. 29, 2007

(65) Prior Publication Data

US 2007/0186832 A1 Aug. 16, 2007

(30) Foreign Application Priority Data

Feb. 13, 2006 (JP) ..... 2006-035118

(51) Int. Cl.
*D05B 19/00* (2006.01)

(52) U.S. Cl. ..... 112/470.04; 112/470.01; 700/136

(58) Field of Classification Search ..... 112/78, 112/102.5, 470.01, 470.04, 475.18, 475.19; 700/136–138
See application file for complete search history.

(56) References Cited

U.S. PATENT DOCUMENTS 5,016,550 A 5/1991 Horie et al.
6,321,671 B1 11/2001 Tomita
6,457,429 B1 * 10/2002 Tomita et al. ..... 112/475.19

FOREIGN PATENT DOCUMENTS

| | | |
|---|---|---|
| JP | A 3-060689 | 3/1991 |
| JP | A 5-006152 | 1/1993 |
| JP | A 9-132859 | 5/1997 |
| JP | A 9-271592 | 10/1997 |
| JP | A 2001-000761 | 1/2001 |

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

A sewing machine includes a display device, a display data storage device storing pattern display data for displaying each sewing pattern on the display device and pattern group display data for displaying on the display device a pattern group indication mark indicative of each of a plurality of pattern groups obtained by classifying the sewing patterns, a selecting operation device selecting one of the sewing groups and further either or any one of the sewing patterns contained in the selected pattern group, and a display control device which, when one of the pattern groups has been selected, causes the display device to display the pattern group indication mark indicative of the selected sewing pattern group on the display device firstly in an enlarged size and subsequently in a reduced normal size, based on the pattern group display data of the selected pattern group.

5 Claims, 20 Drawing Sheets

FIG.3

20a

| PATTERN GROUP | PATTERN NUMBER | PATTERN DISPLAY DATA | SEWING CONDITION DISPLAY DATA |
|---|---|---|---|
| PREFERENTIAL UTILITY PATTERN GROUP | 1 | ..... | ..... |
| | 2 | ..... | ..... |
| | 3 | ..... | ..... |
| | ⋮ | ⋮ | ⋮ |
| | 10 | ..... | ..... |
| UTILITY PATTERN GROUP | 1 | ..... | ..... |
| | 2 | ..... | ..... |
| | 3 | ..... | ..... |
| | ⋮ | ⋮ | ⋮ |
| | 15 | ..... | ..... |
| DECORATIVE PATTERN GROUP | 1 | ..... | ..... |
| | 2 | ..... | ..... |
| | 3 | ..... | ..... |
| | ⋮ | ⋮ | ⋮ |
| | 55 | ..... | ..... |
| CHARACTER PATTERN GROUP | 1 | ..... | ..... |
| | 2 | ..... | ..... |
| | 3 | ..... | ..... |
| | ⋮ | ⋮ | ⋮ |
| | 10 | ..... | ..... |

20b

| PATTERN GROUP | PATTERN GROUP DATA FOR NORMAL DISPLAY | PATTERN GROUP DATA FOR ENLARGED DISPLAY |
|---|---|---|
| PREFERENTIAL UTILITY PATTERN GROUP | | |
| UTILITY PATTERN GROUP | | |
| DECORATIVE PATTERN GROUP | | |
| CHARACTER PATTERN GROUP | | |

FIG. 4

20c

| NUMERAL | NUMERAL DISPLAY DATA FOR NORMAL DISPLAY | NUMERAL DISPLAY DATA FOR ENLARGED DISPLAY |
|---|---|---|
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| 0 | 0 | 0 |

FIG.5

SEWING MACHINE

CROSS-REFERENCE TO RELATED APPLICATIONS

This application is based upon and claims the benefit of priority from the prior Japanese Patent Application No. 2006-35118 filed on Feb. 13, 2006, the entire contents of which are incorporated herein by reference.

BACKGROUND

1. Technical Field

The present disclosure relates to a sewing machine which executes a sewing operation so that a sewing pattern selected from a plurality of sewing patterns is sewn.

2. Description of the Related Art

There have conventionally been provided, for example, household electronically controlled sewing machines which are capable of sewing a number of sewing patterns including utility patterns, character patterns, decorative patterns and the like. This type of sewing machine comprises a control device incorporated with a read only memory (ROM), a ROM card, etc. all of which store pattern display data regarding a number of sewing patterns and sewing data in correspondence with pattern numbers. In this case, a user operates a pattern selecting device to select a desired sewing pattern. The control device is designed to read sewing data of the selected sewing pattern from the ROM, controlling a sewing mechanism based on the read sewing data thereby to execute a sewing operation.

For example, JP-A-H09-132859 discloses an embroidery sewing machine as a first example of the aforesaid pattern selecting device. The disclosed embroidery sewing machine comprises a large-sized liquid crystal display provided on the front of a sewing pillar. The liquid crystal display includes a touch panel provided on the surface of the liquid crystal display. One screen of the liquid crystal display is adapted to display a number of images of sewing patterns (23 images) each in the form of an operation key (icon). The user touches a part of the touch panel on which a desired sewing pattern is displayed, thereby selecting the desired sewing pattern. More than 100 sewing patterns are available. The screen on which the user selects a sewing pattern extends to a plurality of pages. Accordingly, when cannot find a desired sewing pattern on one page, the user manipulates a page scroll key to refer to another page.

In the aforesaid first example, however, a larger-sized display with a touch panel is necessitated to achieve a high visibility and operability, resulting in a cost increase. In this case, small-sized sewing machines and general household sewing machines have employed relatively small-sized displays in view of problems of spacing or costs.

Furthermore, JP-A-H03-60689 as a second example and corresponding U.S. Pat. No. 5,016,550 disclose a sewing machine including an operation panel mounted on a front of a sewing pillar. The operation panel is provided with a numeral keypad and a small-sized display. The user manipulates the numeral keypad to input a pattern number, thereby designating a desired one of a plurality of sewing patterns.

The display can be rendered relatively smaller in the second example. However, when the number of sewing patterns exceeds 100, for example, it takes a certain time period for the user to look up in a sewing pattern from a list of patterns. With this, the user needs to enter a three-digit numeral operating the keypad. This operation tends to be accompanied with error and thus results in a problem of low operability.

SUMMARY

Therefore, an object of the present disclosure is to provide a sewing machine in which the operability can be improved when the user selects a desired one of a plurality of sewing patterns and this can be achieved with provision of a relatively smaller-sized display.

The present disclosure provides a sewing machine which carries out a sewing operation so that a sewing pattern selected from a plurality of sewing patterns is sewn. The sewing machine comprises a display device, a display data storage device which stores pattern display data utilized to display each sewing pattern on the display device and pattern group display data for displaying on the display device a pattern group indication mark which is indicative of each of a plurality of pattern groups obtained by classifying the sewing patterns and numeral display data for displaying pattern numbers assigned to the respective pattern groups, a selecting operation device which selects one of the sewing pattern groups and further selects any one of the sewing patterns contained in the selected pattern group, the selecting operation device including a number input device for inputting the pattern numbers, and a display control device which, when one of the pattern groups has been selected, causes the display device to display the pattern group indication mark indicative of the selected sewing pattern group on the display device firstly in an enlarged size and subsequently in a reduced normal size, based on the pattern group display data of the selected pattern group, wherein the display control device which causes the display device to display one of the pattern numbers in an enlarged size together with the pattern group indication mark when said one of the pattern numbers has been input thereto by the number input device after selection of the pattern group.

The sewing patterns are classified into a plurality of groups (pattern groups). In selecting a desired sewing pattern, the user operates the selecting operation device so that one of the pattern groups to which the desired pattern belongs is firstly selected. When the pattern group has been selected by the selecting operation device, the display control device reads the pattern group display data indicative of the selected pattern group from the display data storage device, displaying the pattern group indication data in an enlarged size. Accordingly, the user can visually perceive the pattern group indication mark in the enlarged size and hence readily grasp the selected pattern group. In this case, since the pattern group display mark is displayed in the enlarged size, what pattern group has been selected can be displayed in an understandable manner for the user even when the display device has a relatively smaller screen. Since the pattern group indicative mark is displayed in the reduced normal size after completion of display in the enlarged size, the selected pattern group (the current pattern group selecting mode) can usually be confirmed, and display of various pieces of display information other than the pattern group indication mark can be prevented from being disturbed. Furthermore, the user can visually perceive the pattern group indication mark and pattern number each displayed in the enlarged size, and the current pattern group selecting mode and pattern number can easily be grasped in a corresponding manner.

In a preferred form, the display control device controls the display device so that the pattern group indication mark is displayed in the enlarged size for a predetermined period of time and subsequently switched to the normal size. The user can confirm the pattern group indication mark displayed in the enlarged size during the predetermined time period. Additionally, since the switching to the normal size is automatically performed, the operation can be prevented from becoming troublesome.

In further another form, the display control device controls the display device so that the enlarged size of the pattern group indication mark on display is switched to the normal size after expiration of a predetermined period of time from completion of input of the pattern number, and so that the sewing pattern corresponding to the input pattern number is displayed based on the pattern display data. Since the pattern group indication mark on display is reduced into the normal size, display of various pieces of display information other than the pattern group indication mark can be prevented from being disturbed. Moreover, the user can confirm the selected sewing pattern on the display device.

In still further another form, the display data storage device stores both normal display pattern group display data for displaying each pattern group indication mark in the normal size and enlarged display pattern group display data for displaying each pattern group indication mark in the enlarged size obtained by enlarging the normal size by a predetermined magnification ratio. The displayed pattern group indication mark and the pattern number in the enlarged size are similar in shape to those in the normal size. Accordingly, the pattern group indication mark and pattern number can readily be understood and perceived.

BRIEF DESCRIPTION OF THE DRAWINGS

Other objects, features and advantages of the present disclosure will become clear upon reviewing the following description of the embodiment with reference to the accompanying drawings, in which:

FIG. 3 is a view explaining data structure of a pattern display memory;

FIG. 4 is a view explaining data structure of a mark memory;

FIG. 5 is a view explaining data structure of a numeral memory;

DETAILED DESCRIPTION OF THE DISCLOSURE

One embodiment of the present disclosure will be described with reference to the accompanying drawings. The disclosure is applied to an electronically controlled zigzag sewing machine (will hereafter be referred to as "sewing machine") M in the embodiment.

Figure 1:
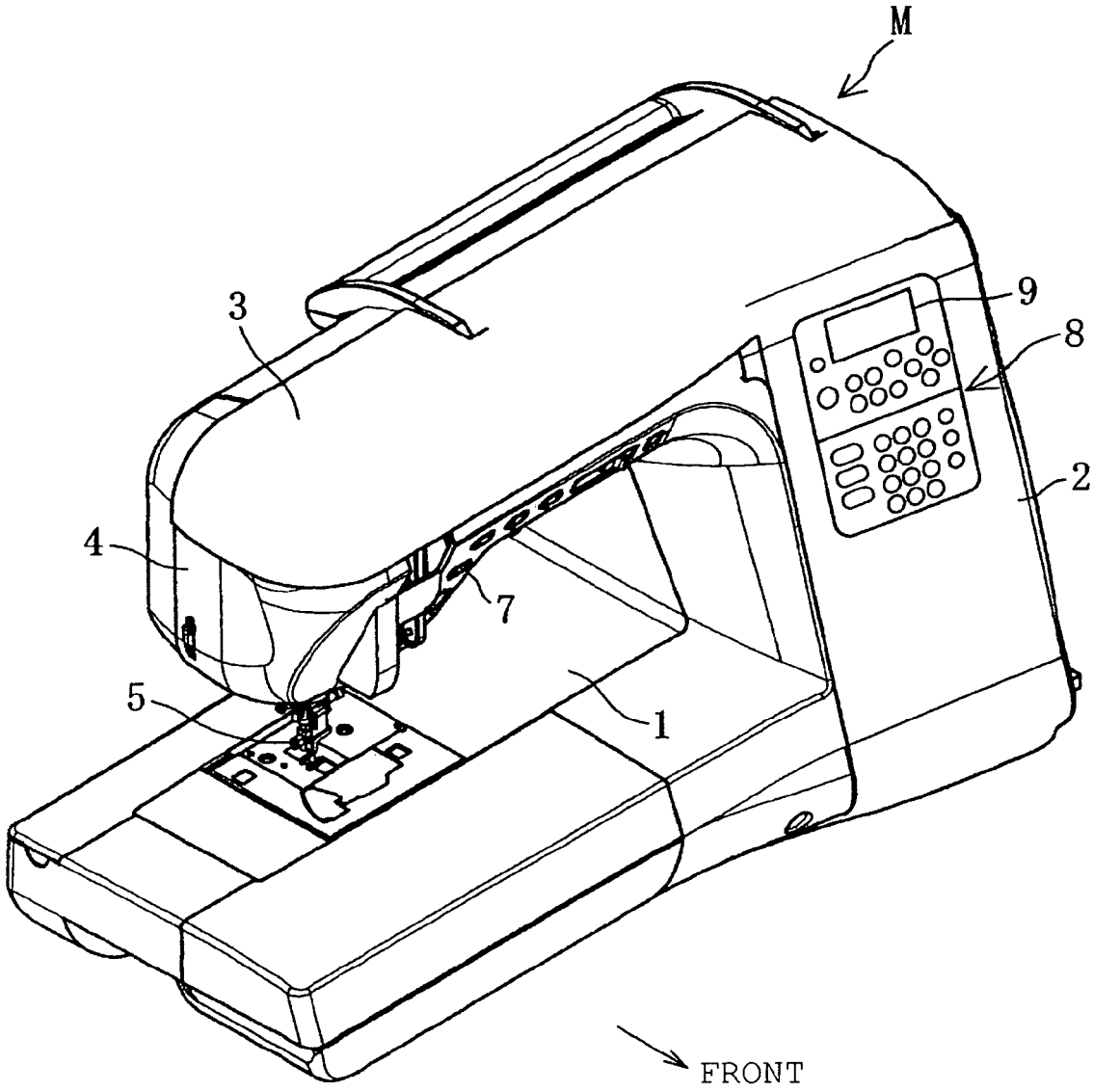
FIG. 1 is a perspective view of a whole sewing machine of one embodiment in accordance with the present disclosure.

Referring to FIG. 1, the sewing machine M of the embodiment includes a sewing bed 1, a sewing pillar 2 standing upward from a right end of the bed 1, an arm 3 extending leftward from an upper end of the pillar 2 and a head 4 provided on a left part of the pillar 2, all of which are formed integrally with one another, as general household electronically controlled sewing machines.

Figure 2:
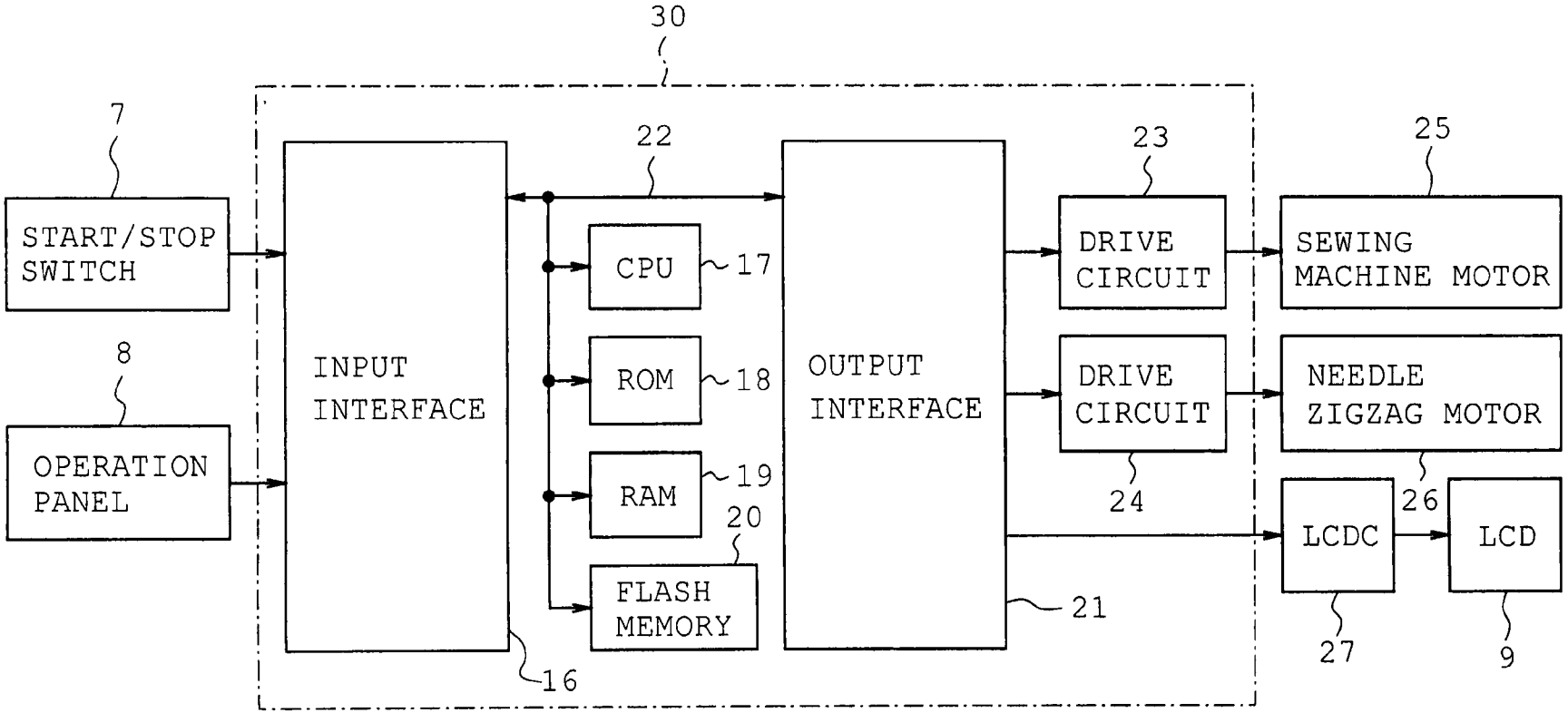
FIG. 2 is a block diagram showing an electrical arrangement of the of the sewing machine.

The arm 3 includes a sewing machine main shaft (not shown) extending in a horizontal direction and a sewing machine motor 25 (see FIG. 2) for rotating the sewing machine main shaft. Furthermore, a hand-driven pulley (not shown) is provided for rotating the sewing machine main shaft so that the sewing machine main shaft is externally operable.

The head 4 is provided with a needle bar (not shown) having a lower end to which a sewing needle 5 is attached. Rotation of the sewing machine main shaft is transmitted via a needle bar driving mechanism (not shown) to the needle bar, whereby the needle bar is adapted to be moved vertically. The arm 3 is provided with a needle swinging mechanism (not shown) for swinging the needle bar in the horizontal direction perpendicular to a cloth feed direction, a thread take-up driving mechanism (not shown) for moving a thread take-up up and down in synchronization with the vertical movement of the needle bar and the like. Various switches are provided on a front of the arm 3. These switches include a start/stop switch 7 instructing start and stop of a sewing operation.

In the bed 1 are provided a thread cutting mechanism and a cloth feeding mechanism for moving a feed dog in a vertical direction and in a cross direction, neither of which is shown. The bed 1 is further provided with a horizontal rotary hook accommodating a bobbin and carrying out a sewing operation in cooperation with the needle 5 while supplying a bobbin thread. The pillar 2 has a front on which a vertical operation panel 8 is mounted. The operation panel 8 includes a small-sized liquid crystal display 9 mounted on an upper part thereof.

The liquid crystal display 9 has an upper, first display row 9*a* and a lower, second display row 9*b*, thus performing a 2-row display. Each of the display rows 9*a* and 9*b* is composed of 16 dots. Utility patterns, decorative patterns and character patterns are displayed on the liquid crystal display 9 when a desired sewing pattern is to be selected. Furthermore, a mark indicative of the type of a cloth presser is displayed on the first display row 9*a*. On the second display row 9*b* are displayed numeral values of thread tension degree, needle zigzag width, stitch length and the like together with marks. All of these numeral values serve as sewing conditions as will be described later.

On the left part of the operation panel 8 are provided a preferential utility pattern group key 13, a utility pattern group key 10, a decorative pattern key 11, a character pattern key 12 and the like each for selecting a pattern group as will be described later. The operation panel 8 further has numeral keys 14 including numerals 0 to 9 and marks of the ten preferential utility patterns, an OK key 15 and the like.

The sewing machine M further includes a pattern list panel which is not shown. The pattern list panel describes a preferential utility pattern group, a utility pattern group, a decorative pattern group and a character pattern group obtained by classifying a plurality of sewing patterns. The sewing patterns are accompanied with respective pattern numbers which will be described later. The pattern list panel is detachably attached to an upper part of the arm 3. Alternatively, a thin sheet (film) on which a pattern list is printed may be affixed to the front of the bed 1. Additionally, an operation manual of the sewing machine also describes the same pattern list.

In the embodiment, a number of sewing patterns which can be sewn by the sewing machine M are divided into four pattern groups, that is, a preferential utility pattern group, a utility pattern group, a decorative pattern group and a character pattern group. The preferential utility pattern group includes 10 utility patterns having higher frequency of use in the utility pattern group. Such 10 utility patterns include straight stitches, triple stitches, zigzag stitches, over casting, etc. The utility pattern group includes other utility patterns such as various types of button holing, bar-tack stitches, button sewing, etc. The decorative pattern group includes, for example, patterns of flowers, simple figures, frame patterns, etc. The character pattern group includes a plurality of character patterns such as alphabet (large letters, small letters, decorative letters) and numerals. Although the number of sewing patterns exceeds 100 in this case, the number of sewing patterns belonging to each pattern group is less than 100 (2 digits) The arrangement of the control system of the sewing machine M will now be described with reference to a block diagram of FIG. 2. The sewing machine M includes a control device 30 composed of a microcomputer as a main component and has a central processing unit (CPU) 17, a read only memory (ROM) 18, a random access memory (RAM) 19 and an electrically rewritable non-volatile flash memory 20, a bus 22 such as data bus electrically connecting these devices to one another, an input interface 16, an output interface 21, a plurality of drive circuits 23 and 24 and the like.

The start/stop switch 7, the operation panel 8 and the like are connected to the input interface 16. To the output interface 21 are connected the drive circuit 23 for the sewing machine motor 25, the drive circuit 24 for a needle zigzag motor 26, a liquid crystal display controller (LCDC) 27 and the like.

The ROM 18 stores a drive control program for driving the sewing machine motor 25 and the needle zigzag motor 26, a sewing pattern display control program and the like. The RAM 19 is provided with a sewing data memory for storing sewing data of the selected sewing pattern, a display buffer for storing display data to be displayed on the liquid crystal display 9 and other memories and buffers. A flash memory 20 is provided with a pattern display memory 20*a* as shown in FIG. 3, a mark memory 20*b* as shown in FIG. 4 and a numeral memory 20*c* as shown in FIG. 5. Data stored by these memories 20*a* to 20*c* are adapted not to be erased even when power is shut off.

The pattern display memory 20*a* stores in the form of data table pattern numbers, pattern display data and sewing condition display data with respect to each of pattern groups obtained by classifying a plurality of sewing patterns. The pattern groups include a preferential utility pattern group, a utility pattern group, a decorative pattern group and a character pattern group. Pattern numbers 1, 2 . . . are assigned to the patterns in each pattern group. The pattern display data is provided for displaying each sewing pattern on the display 9. The sewing condition data is provided for displaying a type of the cloth presser, thread tension degree, needle zigzag width and stitch length. Sewing conditions in this display data are set so as to be optimum conditions (various conditions of a type of the cloth presser, thread tension degree, needle zigzag width and stitch length) in sewing a sewing pattern.

The mark memory 20*b* stores pattern group display data for displaying on the display 9 pattern group indication marks 13A, 10A, 11A and 12A (see FIGS. 10 to 13) indicative of the preferential utility pattern group, utility pattern group, decorative pattern group and character pattern group respectively. More specifically, as also shown in FIG. 4, the pattern group indication mark 13A indicative of the preferential utility pattern group is an image of a circle in which ten push buttons (ten numeral keys 14 on the operation panel 8) are arranged. The pattern group indication mark 10A indicative of the utility pattern group is an image of a square frame in which a straight stitch, zigzag stitch and button holing stitch are arranged. The decorative pattern group indication mark 11A indicative of the decorative pattern group is an image of a square frame in which a tree branch and numeral 1 are arranged. The character pattern group indication mark 12A indicative of the character pattern group is an image of a square frame in which character A is arranged. The mark memory 20*b* stores normal display pattern group display data for displaying each of the pattern group indication marks 10A, 11A, 12A and 13A in a normal size and enlarged display pattern group display data for displaying each pattern group indication mark in an enlarged size obtained by enlarging the normal size at a predetermined magnification. The normal display pattern group display data is composed of 16×16 dots which are displayable on one row of the display 9. The enlarged display pattern group display data is composed of 24×24 dots which are displayable on the first and second display rows 9*a* and 9*b* of the display 9. Thus, each of the enlarged size pattern group indication marks 10A, 11A, 12A and 13A is displayed at 1.5-fold magnification of the normal size.

The numeral memory 20*c* stores numeral display data for displaying patterns numbers affixed in the respective pattern groups relative to the respective pattern display data. More specifically, the numeral memory 20*c* stores, in a table format, numeral display data for normal display which displays numerals 1, 2, 3, 4, 5, 6, 7, 8, 9 and 0 in a normal size and numeral display data for enlarged display which displays the numerals in an enlarged size obtained by enlarging the normal size at a predetermined magnification ratio. The numeral display data for the normal display is composed of 16×7 dots which correspond to one row of the liquid crystal display 9. The numeral display data for the enlarged display is composed of 24×17 dots which correspond to two rows of the liquid crystal display 9. In other words, each numeral (pattern number) in the enlarged size is displayed at 1.5-fold magnification of the normal size.

The control device 30 is adapted to display one of the pattern group indication marks 10A, 11A, 12A and 13A selected on the operation panel 8, the pattern number, the sewing pattern and the like on the display 9 as will be described in detail later. The control device 30 further controls actuators such as the sewing machine motor 25, needle zigzag motor 26, etc. in accordance with a control program and the sewing data, thereby carrying out sewing of the selected sewing pattern.

A manner of controlling sewing pattern display will now be described with reference to the flowcharts of FIGS. 6 to 9. These flowcharts show processing procedures carried out by the control device 30. Symbol Si (where i=11, 12, 13 . . . ) designates each step. Upon start of sewing pattern display control after power-on, a first numeral input flag instructing input of a first numeral (tens digit) of a two-digit numeral is set (first numeral input flag←1) so that the first numeral input state is instructed (S11). Subsequently, a key scanning process is carried out to detect one of the keys 10 to 14 on the operation panel 8 (S12). A key operation flag is then set (key operation flag←1). In this state, a timer is allowed to start a timing operation (S13). When it is determined that any key has been operated, as the result of key scanning (S14: Yes), the control device 30 carries out a control (see FIG. 7) to produce display data of selected pattern corresponding to an operated one of the keys 10 to 14 (S15). The control device 30 controls as follows in the case where the operated key is one of the utility pattern group key 10, decorative pattern group key 11, character pattern group key 12 and preferential utility pattern group key 13 (S21: Yes). In this case, when the key operation flag is set (key operation flag←1; and S22: Yes), the key operation flag is reset (key operation flag←0 at S23), so that the timer starts timing (S24).

Subsequently, the sewing machine is set to a pattern group selection mode corresponding to the operated one of the pattern group keys 10 to 13, that is, the utility pattern group selection mode, decorative pattern group selection mode, character pattern group selection mode or preferential utility pattern group selection mode (S25). Subsequently, pattern group display data for display in the enlarged size corresponding to the set pattern group selection mode is read from the mark memory 20*b* (S27). The pattern group display data of the pattern group indication mark 10A, 11A, 12A or 13A for display in an enlarged size is overwritten and developed on the display buffer so that the pattern group indication marks 10A, 11A, 12A and 13A are displayed over the two rows located in the center of the display 9 (S28).

Figure 6:
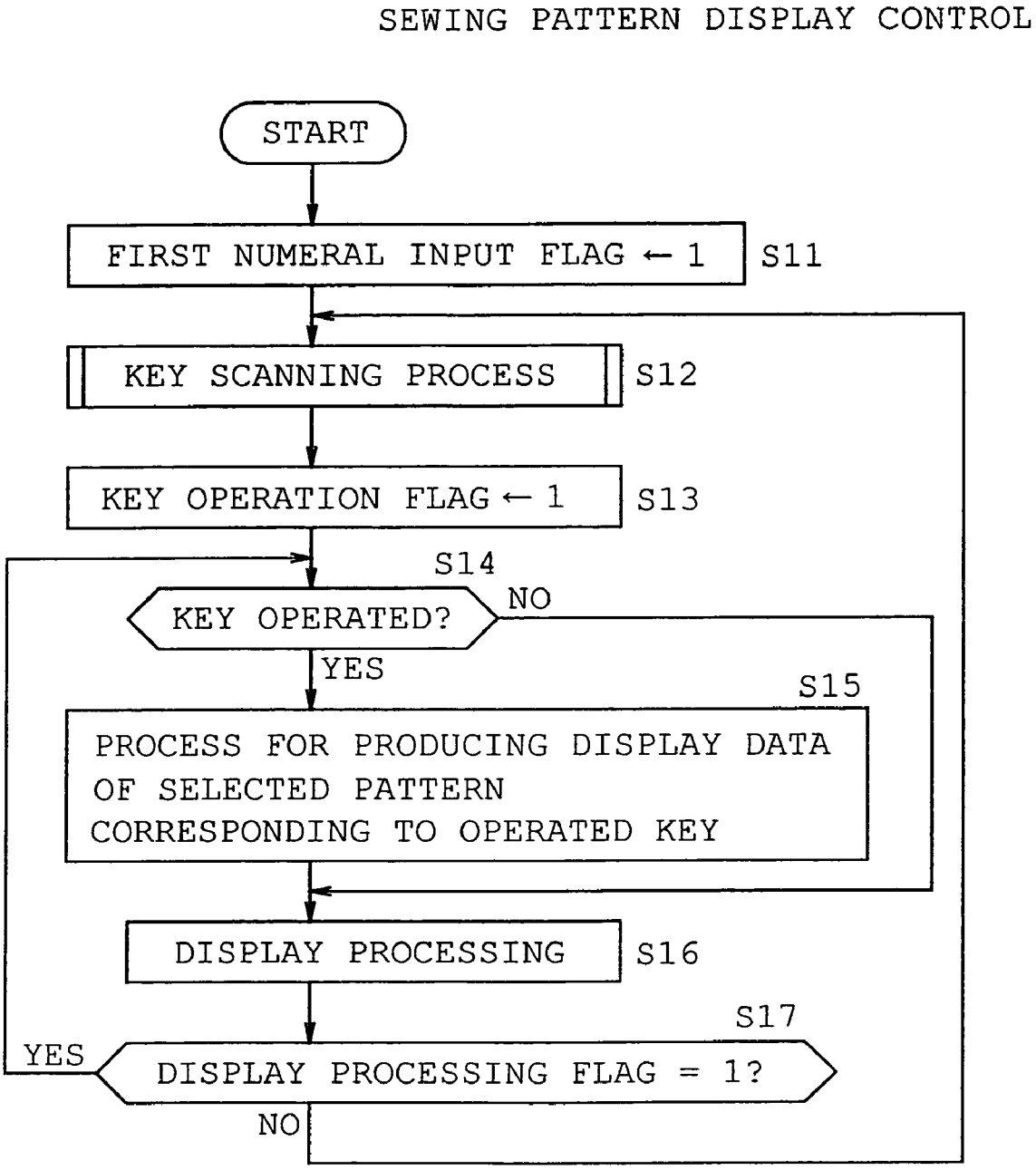
FIG. 6 is a flowchart showing a sewing pattern display control.
Figure 7:
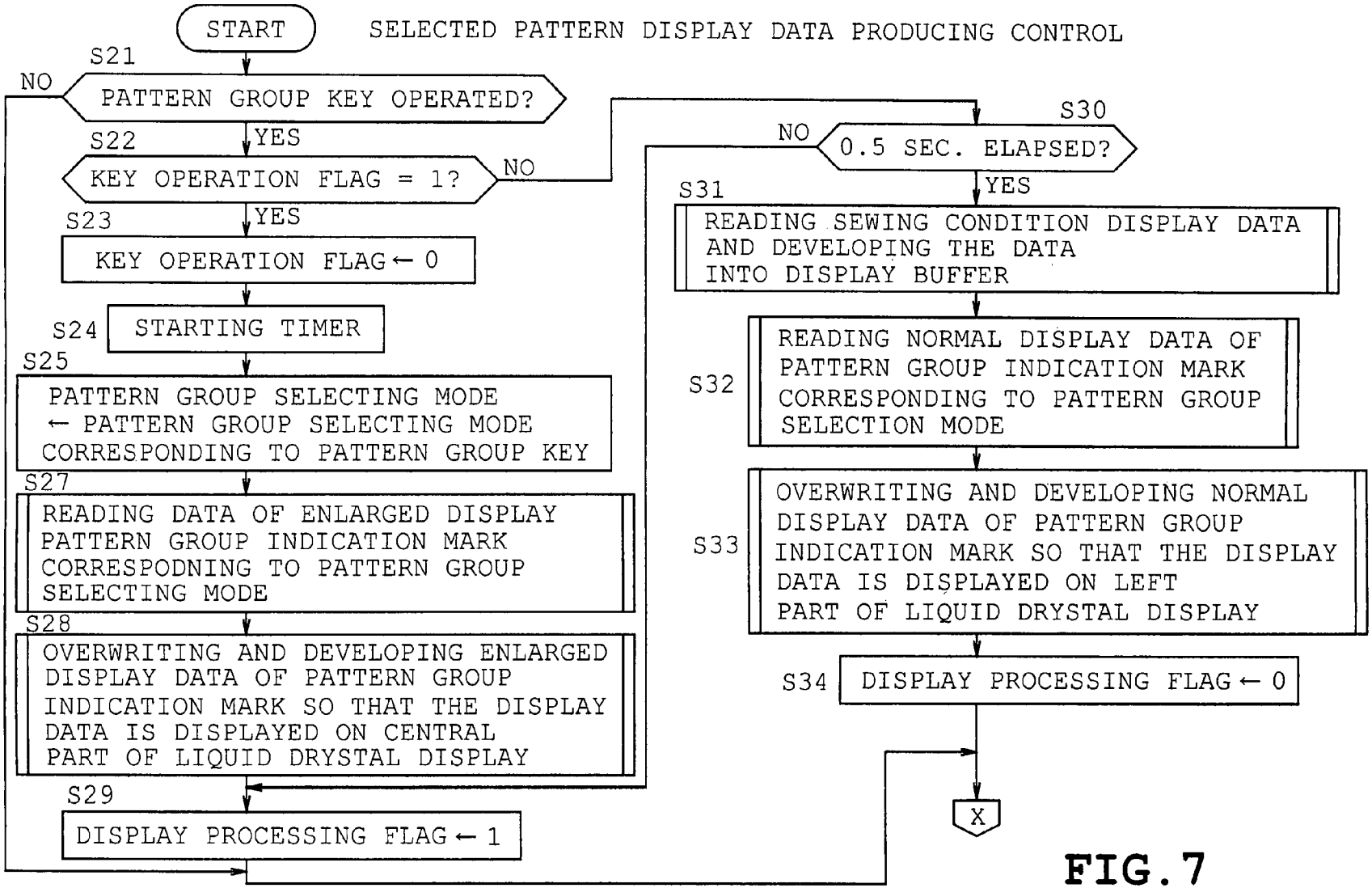
FIG. 7 is a flowchart showing first part of control for producing selected pattern display data.
Figure 8A:
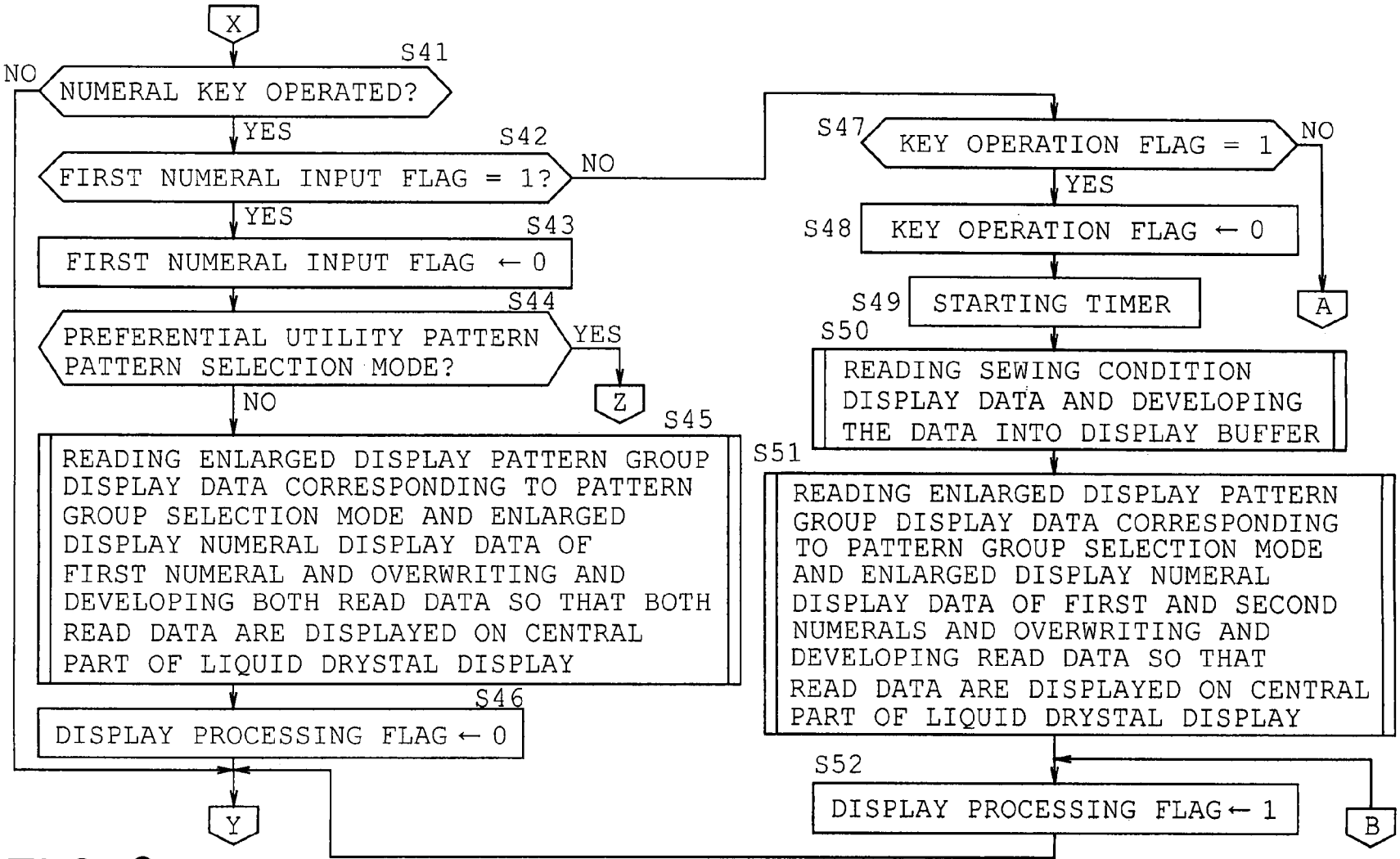
FIGS. 8A and 8B are flowcharts showing second part of control for producing selected pattern display data.
Figure 8B:
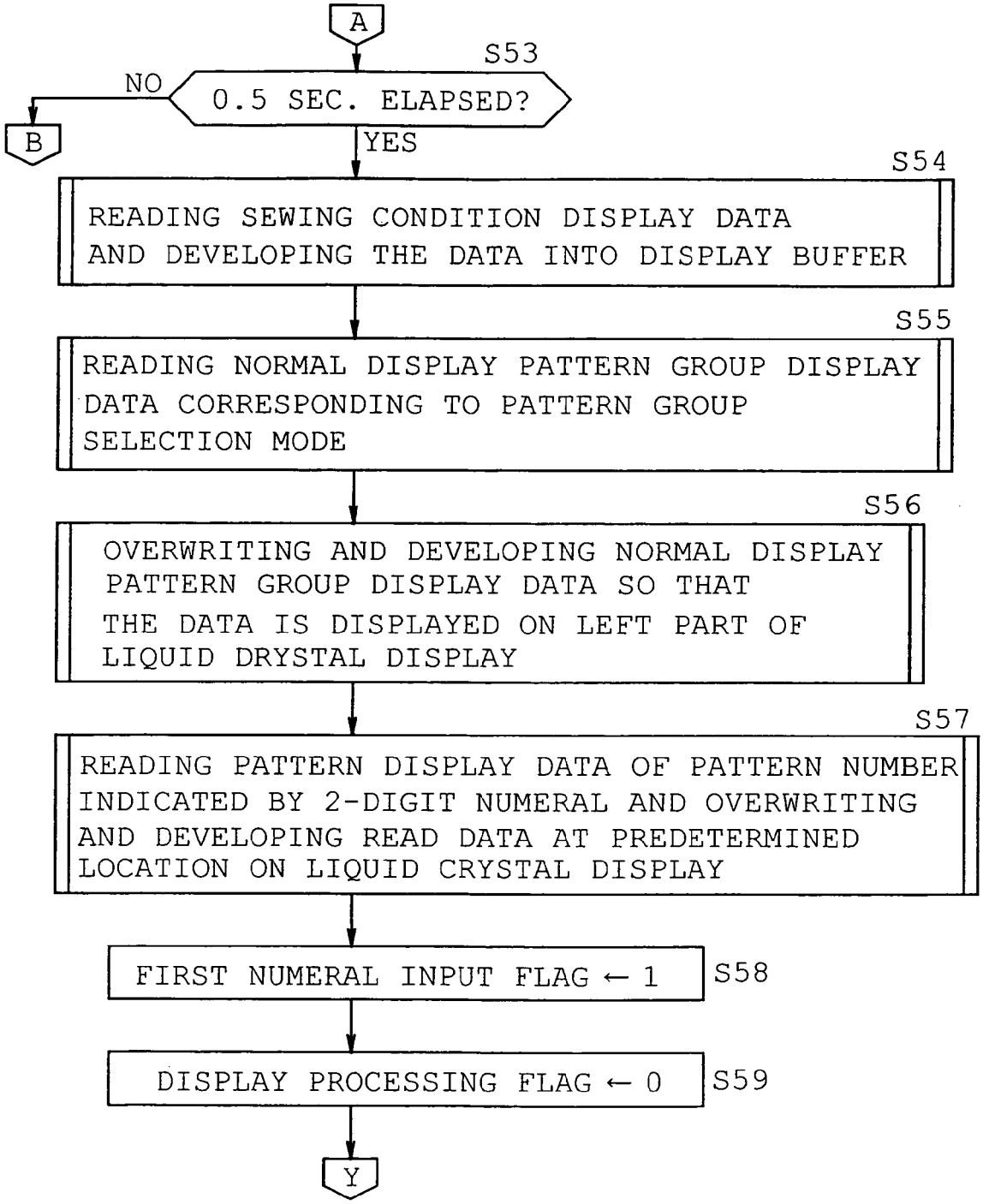
Figure 9:
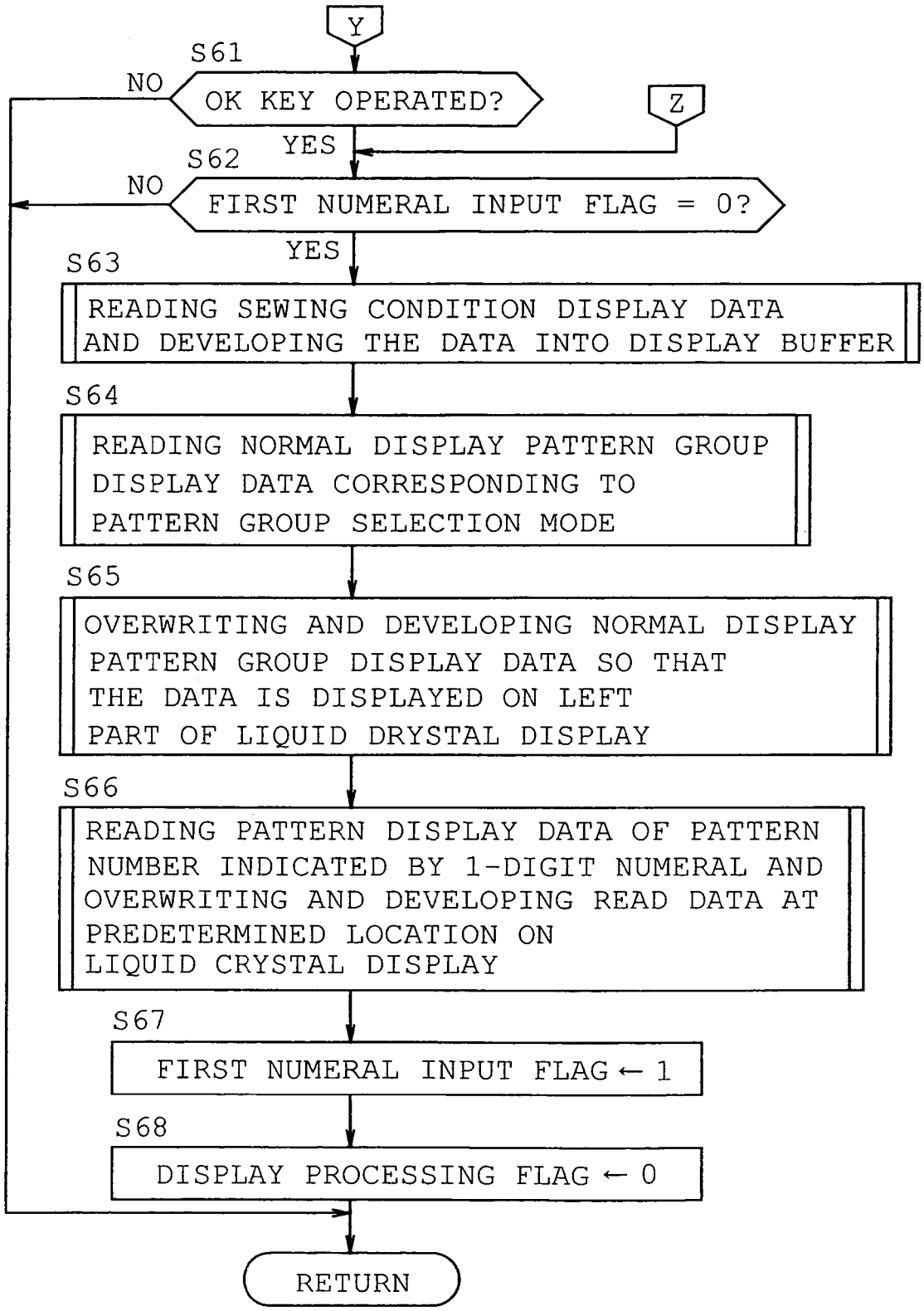
FIG. 9 is a flowchart showing third part of control for producing selected pattern display data.

Subsequently, a display in-process flag indicating that the sequential display process is under execution is set (display processing flag←1 at S29). Thereafter, when the numeral key 14 and the OK key 15 have not been operated (S41: No in FIG. 8A; and S61: No in FIG. 9 respectively), the control device 30 completes the control, returning to the sewing pattern display control (FIG. 6). In the sewing pattern display control, display date such as the pattern group display data for display in an the enlarged size developed in the display buffer is displayed on the display 9 (S16). When the display processing flag is set (display processing flag←1; and S17: Yes), S14 and subsequent steps are carried out repeatedly. In this case, determination is made in the affirmative at S14 (Yes), and S15 (process for producing selected pattern display data), S16 and S17 are carried out repeatedly.

Accordingly, the selected pattern display data producing process is carried out. When 0.5 sec. has not elapsed after start of timing operation of the timer (S30: No), S29 is carried out so that the display data producing process is terminated. On the other hand, when 0.5 sec. has elapsed after start of timing operation of the timer (S30: Yes), sewing condition display data is read from the pattern display memory 20*a* to be developed into the display buffer (S31). The sewing condition display data contains optimum sewing condition in the set pattern group selection mode (default cloth presser type, thread tension, needle zigzag width and stitch length).

Next, pattern group display data for normal display corresponding to the set pattern group selection mode is read from the mark memory 20*b* (S32). Pattern group display data of pattern group indication marks 10A, 11A, 12A and 13A for the normal display is overwritten and developed into the display buffer so that the pattern group indication marks 10A, 11A, 12A and 13A are displayed on the left end of the second display row 9*b* of the display 9 (S33). Subsequently, the display processing flag is reset (display processing flag←0) such that end of the display processing is indicated (S34). Thereafter, when the numeral key 14 has not been operated (S41: No) and the OK key 15 has not been operated (S61: No), the control device completes the control, returning to the sewing pattern display control. In the sewing pattern display control, the display data developed into the display buffer is displayed on the liquid crystal display 9 (S16). When no display processing flag has been set (display processing flag←0; and S17: No), S12 and subsequent steps are repeated.

When the numeral key 14 has been operated at the above-described S41 (S41: Yes) and the first numeral input flag has been set (the first numeral input flag←1), that is, when the tens digit numeral has been input (S42: Yes), the first numeral input flag is reset (first numeral input flag←0 at S43). Subsequently, when the set pattern group selection mode is not the preferential utility pattern group selection mode (S44: No), pattern group display data for the enlarged display corresponding to the set pattern group selection mode (namely, the utility pattern group selection mode, the decorative pattern group selection mode or character pattern group selection mode). Furthermore, numeral display data of the first numeral (tens digit numeral) for enlarged display is read from the numeral memory 20*c*. Pattern group display data of the pattern group indication marks 10A, 11A, 12A and 13A for enlarged display and numeral display data of the first numeral for enlarged display are overwritten and developed into the display buffer so that the pattern group indication marks 10A, 11A, 12A and 13A and the first numeral are displayed over the two rows located in the center of the display 9 (S45).

Subsequently, the display processing flag is reset (display processing flag←0 at S46). Thereafter, when the OK key 15 has not been operated (S61: No), the control device 30 completes the control, returning to the pattern selection display control. In the sewing pattern display control, as described above, display data developed in the display buffer is displayed on the liquid crystal display 9 (S16). When the display processing flag has not been set (display processing flag←0; and S17: No), S12 and subsequent steps are carried out repeatedly. In this case, key scan processing is carried out (S12). When the numeral key 14 has been operated (S14: Yes; and a second numeral setting operation as will be described later), the control device 30 determines in the affirmative (Yes) at S41 and in the negative at S42.

Subsequently, when the key operation flag has been set (key operation flag←1; and S47: Yes), the key operation flag is reset (key operation flag←0 at S48) and the timing operation by the timer is started (S49). In the same manner as at S31, sewing condition display data is read from the pattern display memory 20*a* and developed in the display buffer (S50). Subsequently, pattern group display data for enlarged display corresponding to the set pattern group selection mode is read from the mark memory 20*b*. Numeral display data of the first and second numerals (the tens and units digits respectively) are read from the numeral memory 20*c*. The pattern group display data of the pattern group indication mark 10A, 11A, 12A or 13A for enlarged display and numeral display data of first and second numerals for enlarged display are overwritten and developed in the display buffer so that the pattern group indication marks 10A, 11A, 12A and 13A and the first and second numerals are displayed over the two rows located in the center of the display 9 (S51).

Subsequently, the display processing flag is set (display processing flag←1 at S52). Thereafter, when the OK key 15 has not been operated (S61: No), the control device 30 completes the control, returning to the sewing pattern display control. In the sewing pattern display control, as described above, the display data developed in the display buffer is displayed on the liquid crystal display 9 (S16). When the display processing flag has been set (S17: Yes), S14 and subsequent steps are carried out repeatedly. In this case, the control device 30 determines in the affirmative at S14 and carries out S15 (selected pattern display data producing process), S16 and S17 repeatedly. Accordingly, the control device 30 determines in the affirmative at S41, in the negative at S42, S47 and S53 and then carries out S52 repeatedly until 0.5 sec. elapses from start of the timing operation of the timer. When 0.5 sec. has elapsed from start of the timing operation of the timer (S53: Yes), the sewing condition display data is read from the pattern display memory 20*a* to be developed in the display buffer (S54) in the same manner as at S31. Pattern group display data for the normal display corresponding to the set pattern group selection mode is read from the mark memory 20*b* (S55).

Next, the pattern group display data of the pattern group indication marks 10A, 11A, 12A and 13A for the normal display is overwritten and developed on and in the display buffer so that the pattern group indication marks are displayed on the left end of the second display row 9*b* of the display 9 (S56). Furthermore, pattern display data corresponding to the pattern number indicated by the two-digit number in each pattern group selection mode is read from the pattern display memory 20*a* to be overwritten and developed in the display buffer (S57). The first numeral input flag is then set (first numeral input flag←1 at S58), and the display processing flag is reset (display processing flag←0 at S59).

Subsequently, when the OK key 15 has not been operated (S61: No), the control device 30 completes the control, returning to the sewing pattern display control. In the sewing pattern display control, as described above, the display data developed in the display buffer is displayed on the liquid crystal display 9 (S16). When the display processing flag has not been set (S17: No), S12 and subsequent steps are carried out repeatedly. On the other hand, the following processing is carried out when the OK key 15 has been operated (S61: Yes) after operation of the first numeral key 14 (S41: Yes) and execution of S42 to S46 or the set pattern group selection mode is the preferential utility pattern group selection mode (S44: Yes). When the first numeral input flag has been reset (display processing flag←0), that is, when a tens digit number has been input (S62: Yes), sewing condition display data is read from the pattern display memory 20*a* to be developed in the display buffer (S63) in the same manner as at S31.

Subsequently, pattern group display data for the normal display corresponding to the set pattern group selection mode is read from the mark memory 20*b* (S64). The pattern group display data of the pattern group indication marks 10A, 11A, 12A and 13A for the normal display is overwritten and developed in the display buffer so that the pattern group indication marks are displayed on the left end of the second display row 9*b* of the display 9 (S65). Furthermore, pattern display data corresponding to the pattern number indicated by the one-digit number in each pattern group selection mode is read from the pattern display memory 20*a* to be overwritten and developed in the display buffer (S66). Subsequently, the first numeral input flag is then set (first numeral input flag←1 at S67), and the display processing flag is reset (display processing flag←0 at S68). The control device 30 then completes the control, returning to the sewing pattern display control. In the sewing pattern display control, the display data developed in the display buffer is displayed on the liquid crystal display 9 (S16) as described above. When the display processing flag has not been set (S17: No), S12 and subsequent steps are carried out repeatedly.

Figure 10:
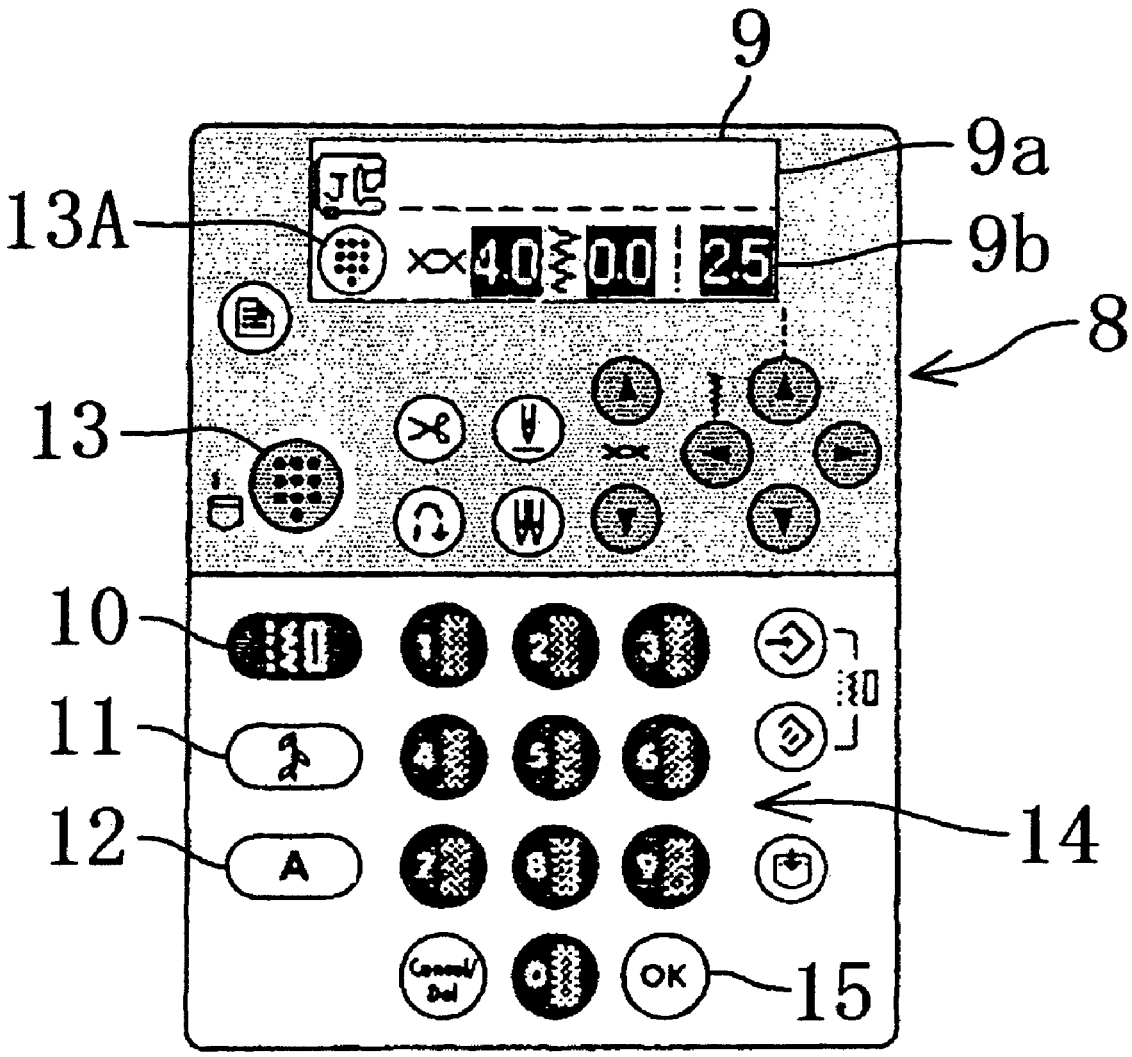
FIG. 10 is a front view of an operation panel on which an initial screen is displayed.

The operation of the sewing machine M will now be described. When power is supplied to the sewing machine M, the initial screen as shown in FIG. 10 is displayed on the display 9. The mark of cloth presser is displayed on the upper first display row 9*a* in the initial screen. Pattern number "01" of straight stitch pattern for the left base needle position line is also displayed on the upper first display row 9*a*. Furthermore, the preferential utility pattern group indication mark 13A, a thread tension mark and its numeral value of 4.0, a needle zigzag width mark and its numeral value of 0.0 and a stitch length mark and its numeral value of 2.5 are displayed on the lower second display row 9*b*.

Figure 11A:
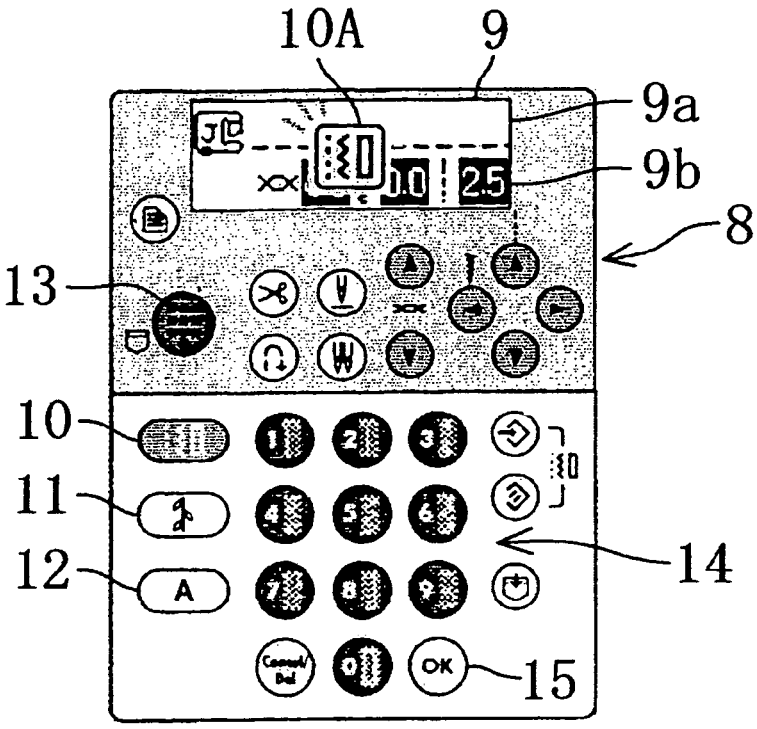
FIG. 11A is a front view of the operation panel on which a utility pattern group indication mark is displayed in an enlarged size.
Figure 11B:
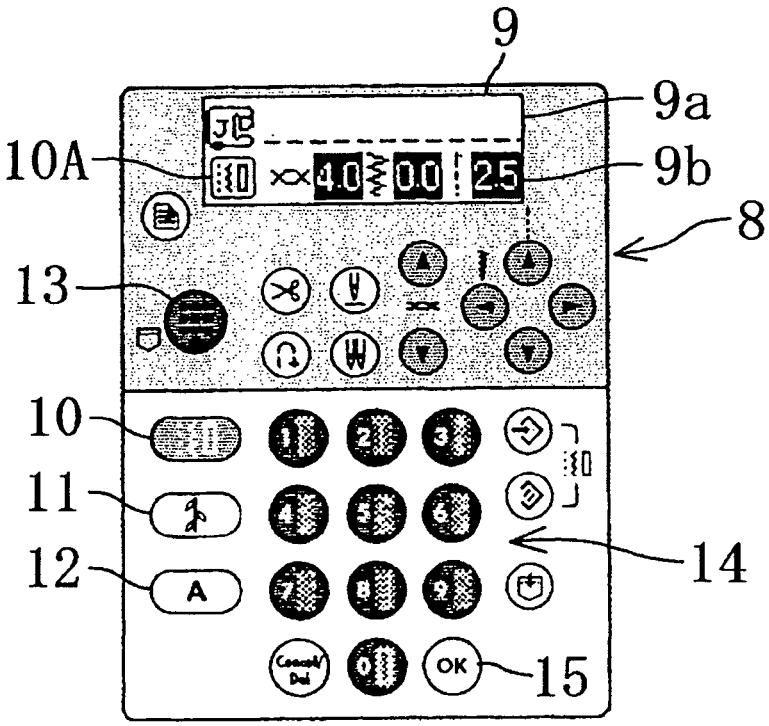
FIG. 11B is a view similar to FIG. 11A, showing the utility pattern group indication mark in a reduced size.

The following describes the operation in the case where the user selects a desired sewing pattern from the aforesaid pattern list panel and a utility pattern of pattern number 38, with reference to FIGS. 11A to 11E. Firstly, when the user operates the utility pattern group key 10, a screen as shown in FIG. 11A is displayed on the display 9. On this screen, the utility pattern group indication mark 10A of the selected utility pattern group is displayed over the first and second display rows 9*a* and 9*b* on the central part of the display 9 in an enlarged size. The enlarged utility pattern group indication mark 10A is displayed for 0.5 sec. Thereafter, the utility pattern group indication mark 10A reduced to the normal size is displayed on the left end of the second display row 9*b* of the display 9 as shown in FIG. 11B.

Accordingly, when viewing the utility pattern group indication mark 10A displayed in the enlarged size, the user clearly understands that the utility pattern group is to be selected currently. Furthermore, since the mark 10A is displayed in the enlarged size for 0.5 sec. and thereafter in the reduced normal size on the left end of the second display row 9*b*, the user can understand that the mark displayed on the left end of the second display row 9*b* is the utility pattern group indication mark 10A and further understand that the current pattern group selection mode is the utility pattern group selection mode, even during the pattern selection as long as the utility pattern group indication mark 10A is displayed.

Figure 11C:
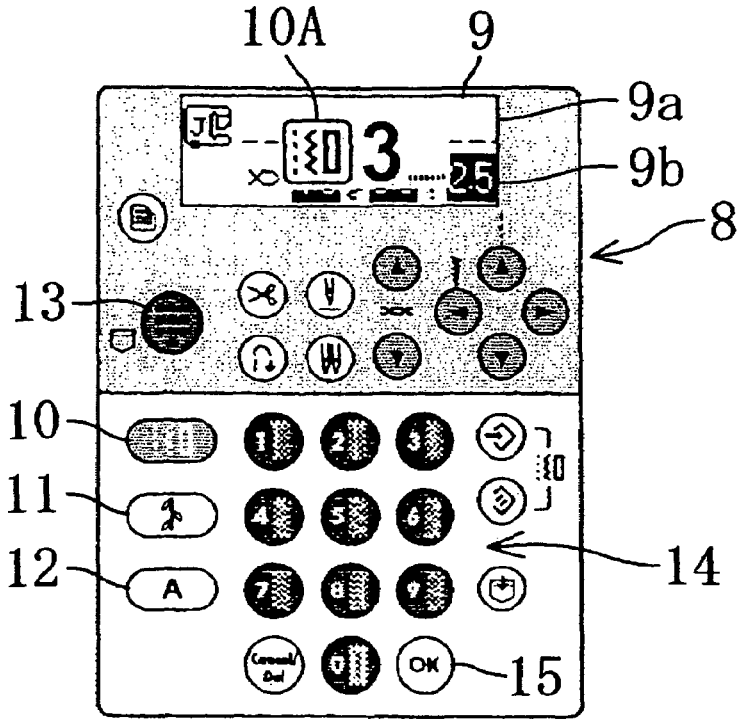
FIG. 11C is a view similar to FIG. 11A, showing the utility pattern group indication mark and first numeral each in an enlarged size.

Thereafter, when the user operates a "3" key corresponding to the numeral "3" of the tens digit in order that the utility pattern number 38 may be selected, a screen as shown in FIG. 11C is displayed on the display 9. On this screen, the utility pattern group indication mark "1A" and numeral "3" are displayed over the first and second display rows 9*a* and 9*b* on the central part of the display 9 in an enlarged size. Accordingly, the user can readily confirm that the current mode is the utility pattern group selection mode and further that the input tens digit is "3".

Figure 11D:
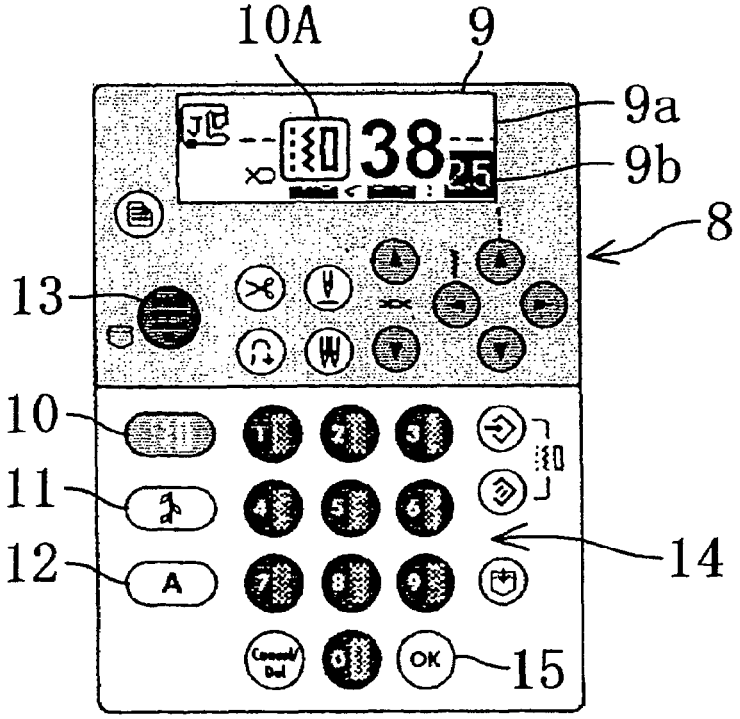
FIG. 11D is a view similar to FIG. 11A, showing the utility pattern group indication mark and first and second numerals each in an enlarged size.
Figure 11E:
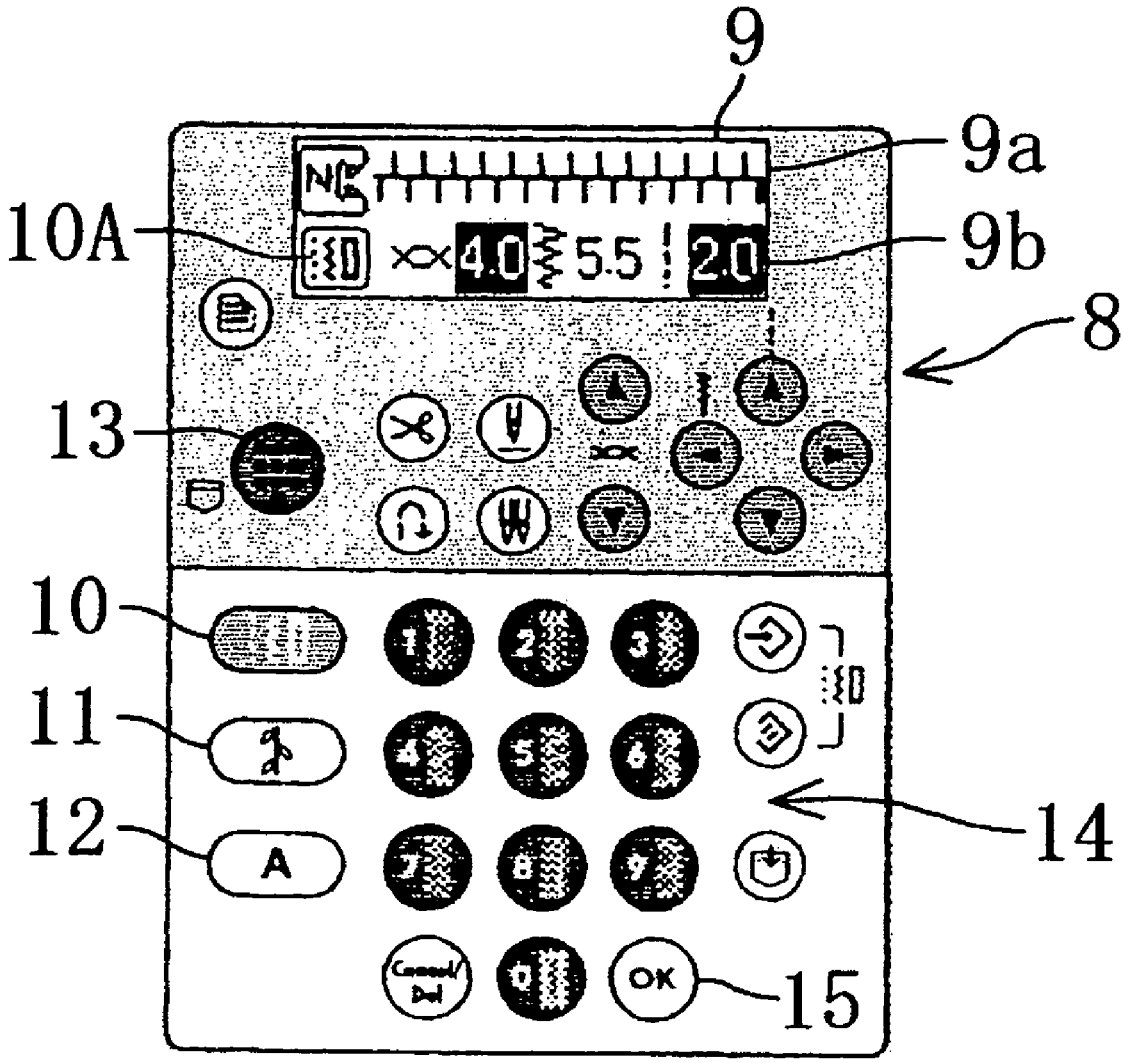
FIG. 11E is a view similar to FIG. 11A, showing the utility pattern group indication mark and utility pattern each in a normal size.

Subsequently, when the user operates an "8" key corresponding to the units digit "8", a screen as shown in FIG. 11D is displayed on the display 9. On this screen, the utility pattern group indication mark "11A", numeral "3" and numeral "8" are displayed over the first and second display rows 9*a* and 9*b* on the central part of the display 9 in an enlarged size. Accordingly, the user can readily confirm that the current mode is the utility pattern group selection mode and further that the input two-digit number is "38". Upon elapse of about 0.5 sec. after the foregoing display, the utility pattern group indication mark "10A" is displayed on the former location in a reduced or normal size. Moreover, a utility pattern of pattern number 38 is displayed on the first display row 9*a* of the display 9. Accordingly, the user readily and reliably understands that the displayed sewing pattern is the utility pattern of pattern number 38.

Figure 12A:
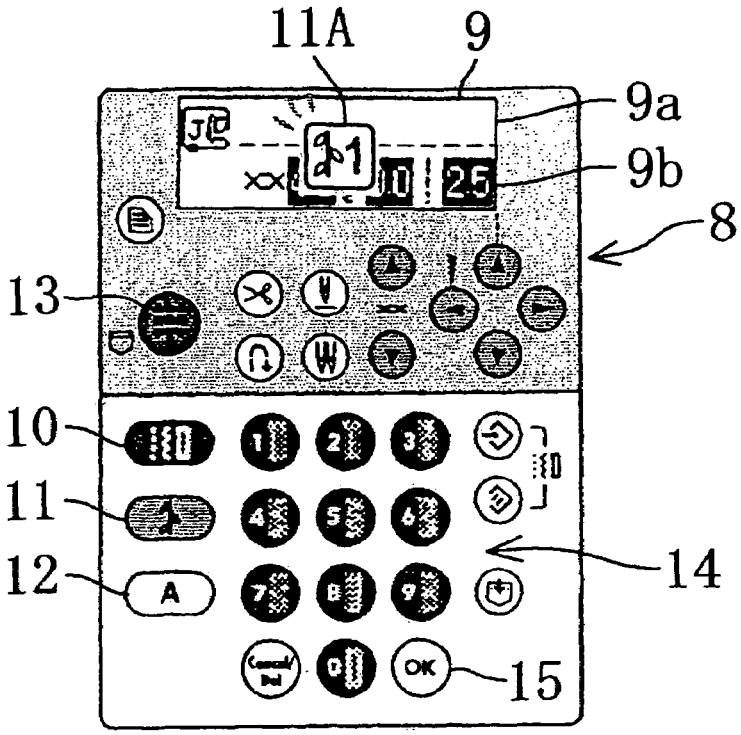
FIG. 12A is a front view of the operation panel on which a decorative pattern group indication mark is displayed in an enlarged size.
Figure 12B:
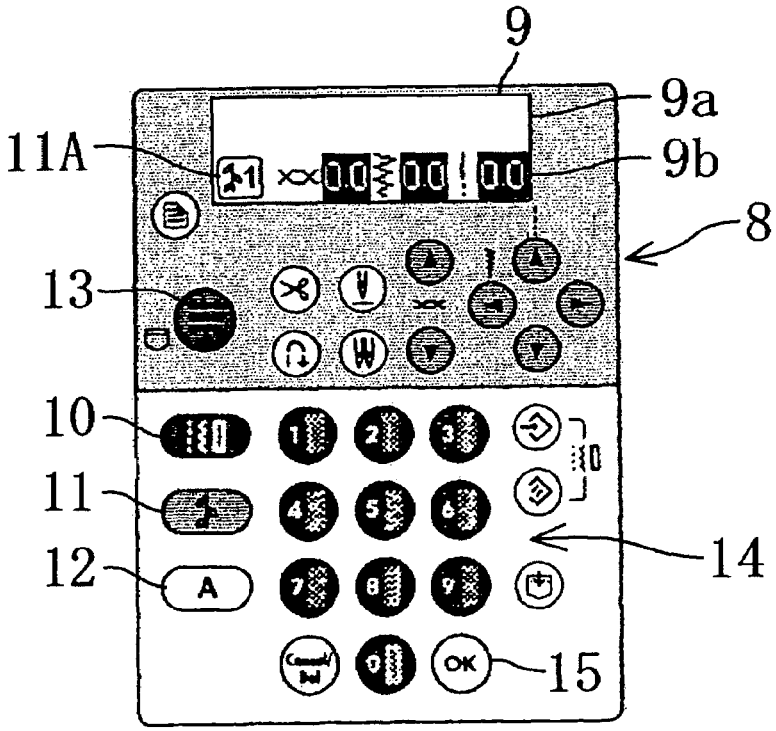
FIG. 12B is a view similar to FIG. 12A, showing the decorative pattern group indication mark in a reduced size.

Now, the following describes the operation in the case where the user selects a desired sewing pattern from the aforesaid pattern list panel and a decorative pattern of pattern number 52, with reference to FIGS. 12A to 12E. Firstly, when the user operates the decorative pattern group key 11, a screen as shown in FIG. 12A is displayed on the display 9. On this screen, a decorative pattern group indication mark 11A of the selected decorative pattern group is displayed over the first and second display rows 9*a* and 9*b* on the central part of the display 9 in an enlarged size. The enlarged decorative pattern group indication mark 11A is displayed for 0.5 sec. Thereafter, the decorative pattern group indication mark 11A reduced to the normal size is displayed on the left end of the second display row 9*b* of the display 9 as shown in FIG. 12B.

Accordingly, when viewing the decorative pattern group indication mark 11A displayed in the enlarged size, the user clearly understands that the decorative pattern group is to be selected currently. Furthermore, since the mark 11A is displayed in the enlarged size for 0.5 sec. and thereafter in the reduced normal size on the left end of the second display row 9*b*, the user can understand that the mark displayed on the left end of the second display row 9*b* is the decorative pattern group indication mark 11A and further understand that the current pattern group selection mode is the decorative pattern group selection mode, even during the pattern selection as long as the decorative pattern group indication mark 11A is displayed.

Figure 12C:
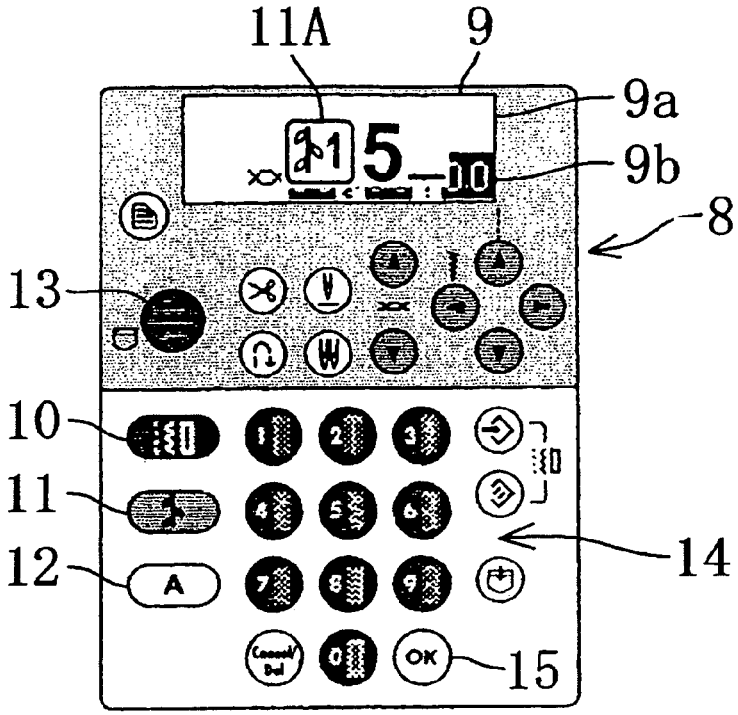
FIG. 12C is a view similar to FIG. 12A, showing the decorative pattern group indication mark and first numeral each in an enlarged size.
Figure 12D:
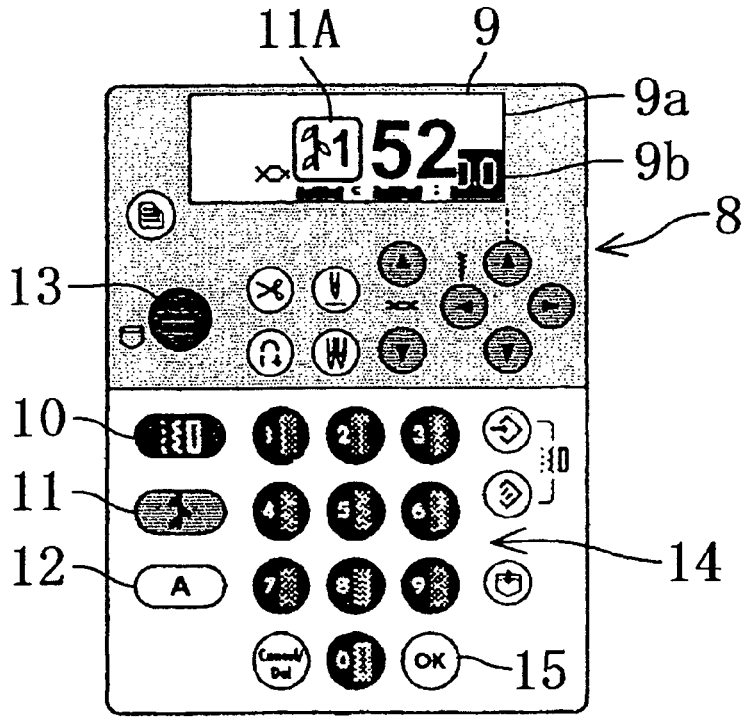
FIG. 12D is a view similar to FIG. 12A, showing the decorative pattern group indication mark, a first numeral and a second numeral each in an enlarged size.
Figure 12E:
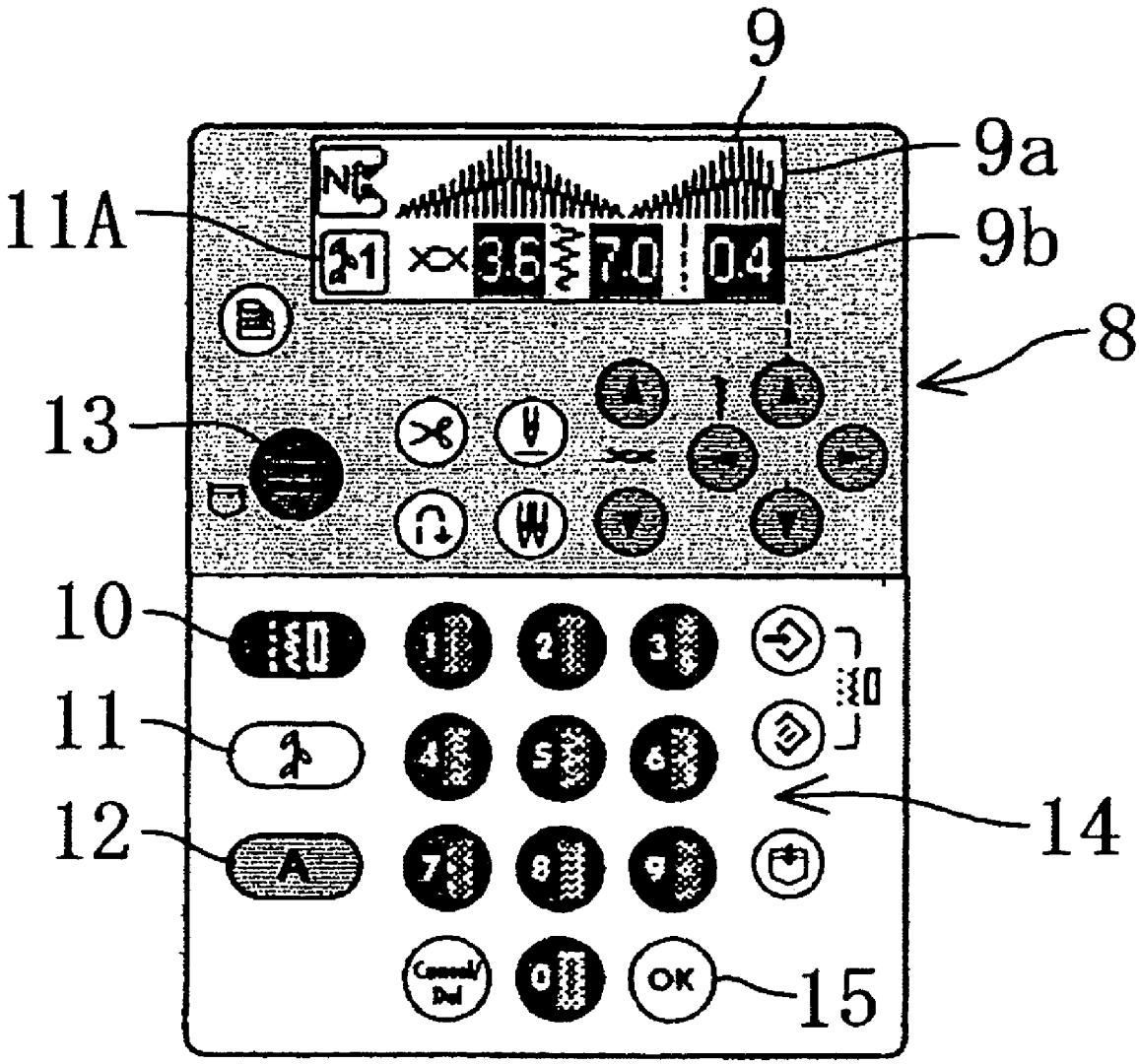
FIG. 12E is a view similar to FIG. 12A, showing the decorative pattern group indication mark and the decorative pattern each displayed in a normal size.

Thereafter, when the user operates a "5" key corresponding to the numeral "5" of the tens digit in order that the decorative pattern number 52 may be selected, a screen as shown in FIG. 12C is displayed on the display 9. On this screen, the decorative pattern group indication mark "11A" and numeral "5" are displayed over the first and second display rows 9*a* and 9*b* on the central part of the display 9 in an enlarged size. Accordingly, the user can readily confirm that the current mode is the decorative pattern group selection mode and further that the input numeral is "5".

Upon elapse of about 0.5 sec. after the foregoing display, the decorative pattern group indication mark "11A" is displayed on the former location in a reduced or normal size. Moreover, a decorative pattern of pattern number 52 is displayed on the first display row 9*a* of the display 9. Accordingly, the user readily and reliably understands that the displayed sewing pattern is the decorative pattern of pattern number 52.

Figure 13A:
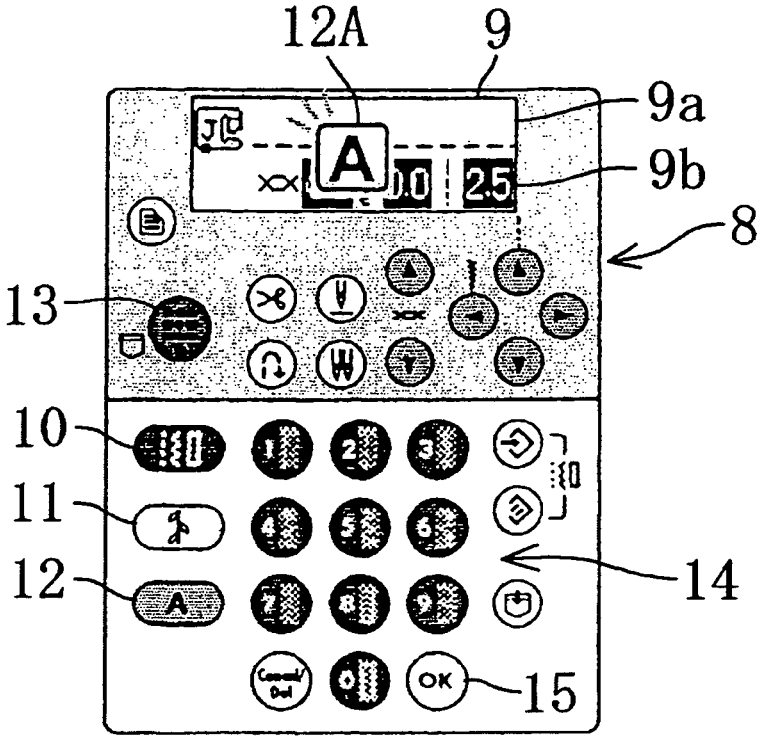
FIG. 13A is a front view of the operation panel on which a character pattern group indication mark is displayed in an enlarged size.
Figure 13B:
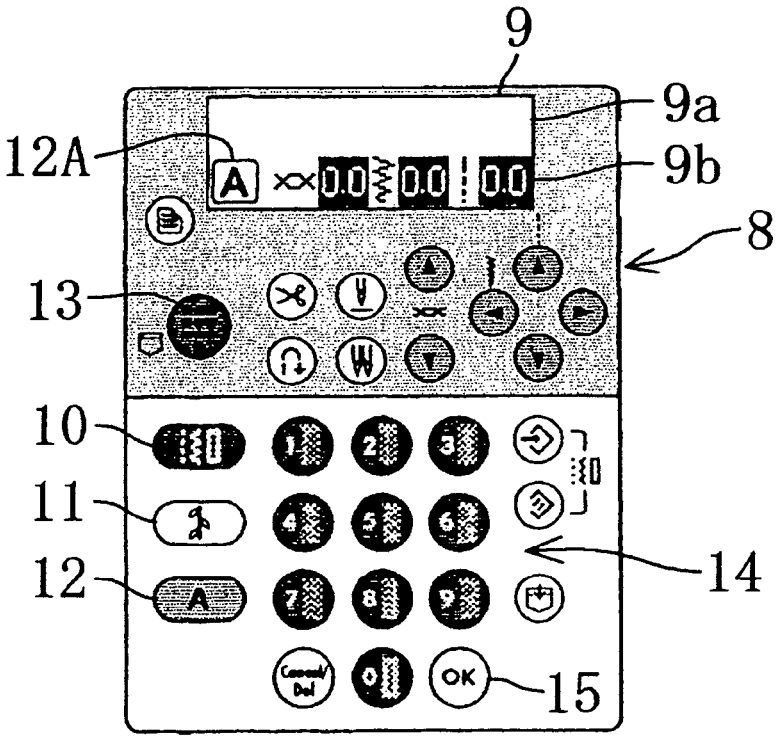
FIG. 13B is a view similar to FIG. 13A, showing the character pattern group indication mark displayed in a reduced size.

The following describes the operation in the case where the user selects a desired sewing pattern from the aforesaid pattern list panel and a character pattern of pattern number 1, with reference to FIGS. 13A to 13E. Firstly, when the user operates the character pattern group key 12, a screen as shown in FIG. 13A is displayed on the display 9. On this screen, a character pattern group indication mark 12A of the selected character pattern group is displayed over the first- and second display rows 9*a* and 9*b* on the central part of the display 9 in an enlarged size. The enlarged character pattern group indication mark 12A is displayed for 0.5 sec. Thereafter, the character pattern group indication mark 12A reduced to the normal size is displayed on the left end of the second display row 9*b* of the display 9 as shown in FIG. 13B.

Accordingly, when viewing the character pattern group indication mark 12A displayed in the enlarged size, the user clearly understands that the character pattern group is to be selected currently. Furthermore, since the mark 12A is displayed in the enlarged size for 0.5 sec. and thereafter in the reduced normal size on the left end of the second display row 9*b*, the user can understand that the mark displayed on the left end of the second display row 9*b* is the character pattern group indication mark 12A and further understand that the current pattern group selection mode is the character pattern group selection mode, even during the pattern selection as long as the character pattern group indication mark 12A is displayed.

Figure 13C:
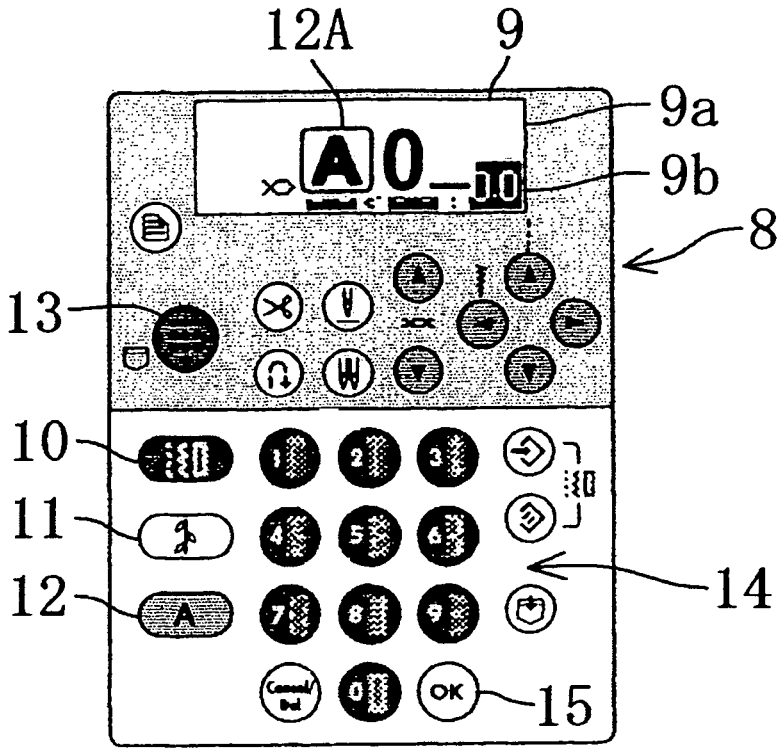
FIG. 13C is a view similar to FIG. 13A, showing the character pattern group indication mark and a first numeral each displayed in an enlarged size.

Thereafter, when the user operates a "0" key corresponding to the numeral "0" of the tens digit in order that the character pattern number 1 may be selected, a screen as shown in FIG. 13C is displayed on the display 9. On this screen, the character pattern group indication mark "12A" and numeral "0" are displayed over the first and second display rows 9*a* and 9*b* on the central part of the display 9 in an enlarged size. Accordingly, the user can readily confirm that the current mode is the character pattern group selection mode and further that the input number is "0".

Figure 13D:
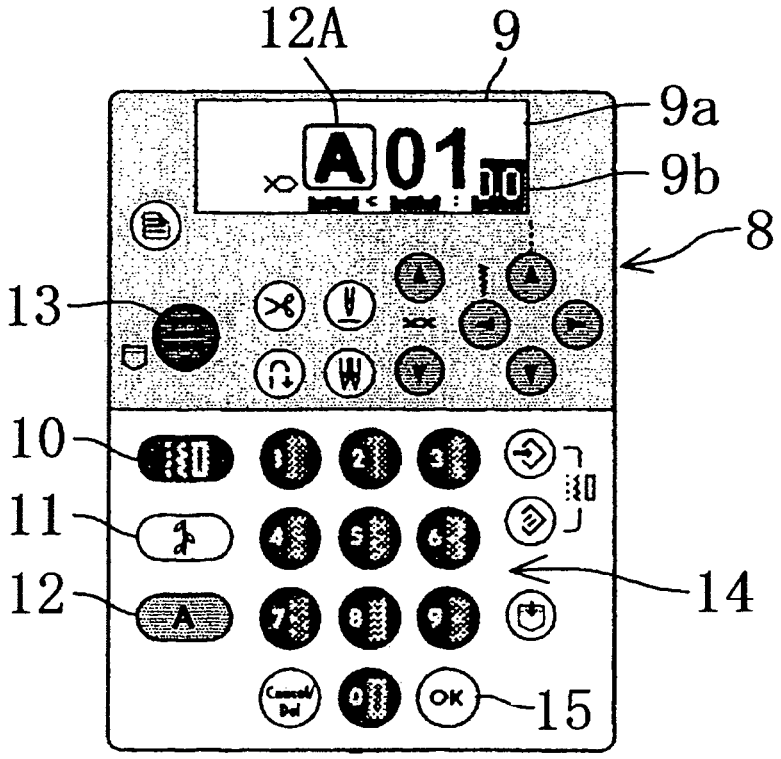
FIG. 13D is a view similar to FIG. 13A, showing the character pattern group indication mark, the first numeral and a second numeral each displayed in an enlarged size.
Figure 13E:
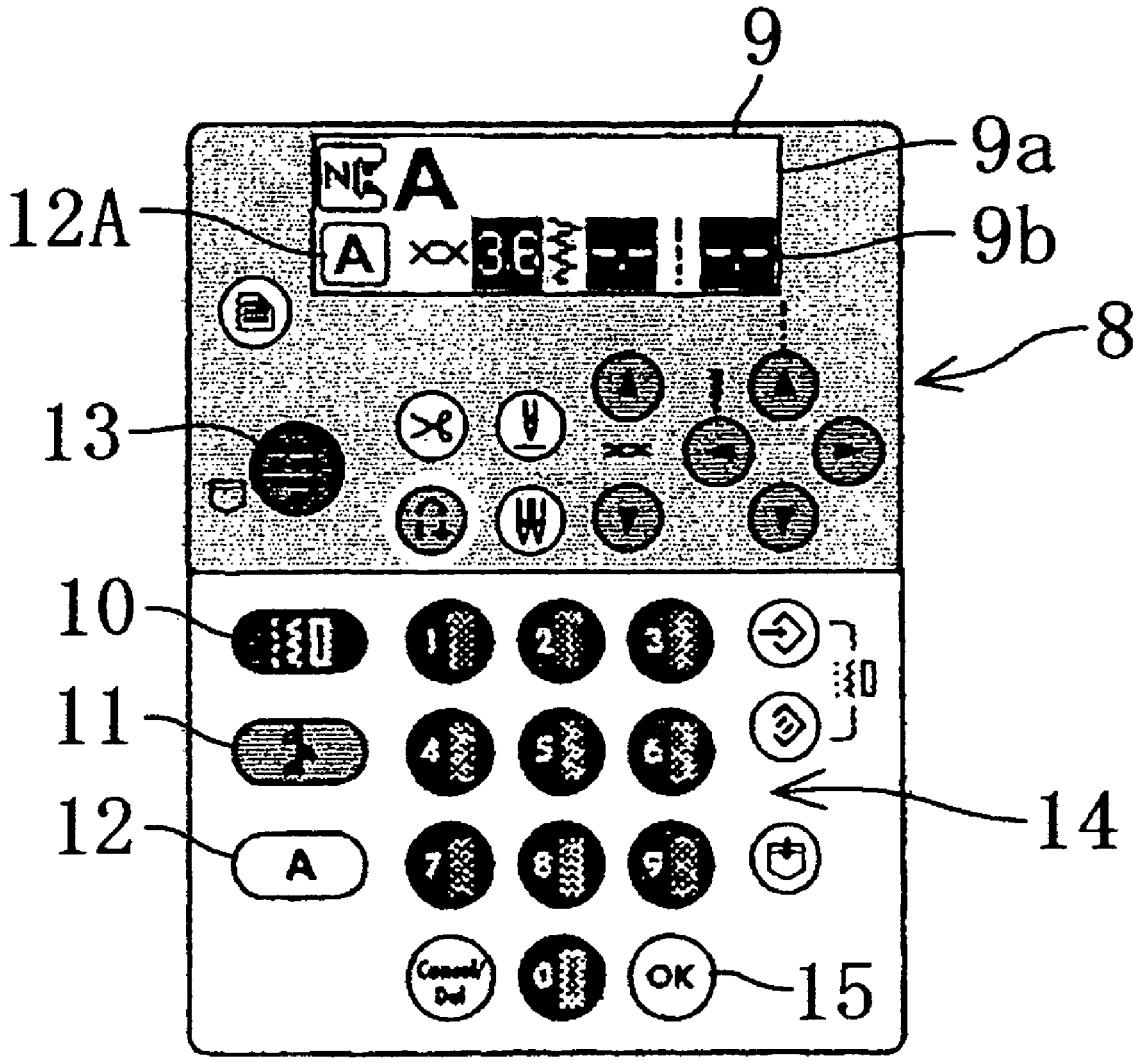
FIG. 13E is a view similar to FIG. 13A, showing the character pattern group indication mark and a character pattern each in a normal size.

Furthermore, when the user operates a "1" key corresponding to the units digit "1", a screen as shown in FIG. 13D is displayed on the display 9. On this screen, the character pattern group indication mark "12A", numeral "0" and numeral "1" are displayed over the first and second display rows 9*a* and 9*b* on the central part of the display 9 in an enlarged size. Accordingly, the user can readily confirm that the current mode is the character pattern group selecting mode and further that the input two-digit number is "01". Upon elapse of about 0.5 sec. after the foregoing display, the character pattern group indication mark "12A" is displayed on the former location in a reduced or normal size as shown in FIG. 13E. Moreover, a character pattern of pattern number 01 is displayed on the first display row 9*a* of the display 9. Accordingly, the user readily and reliably understands that the displayed sewing pattern is the character pattern of pattern number 01. Furthermore, the OK key 15 may be operated after input of the numbers 1 to 9 when the single digit numbers "1" to "9" are input.

The following describes the procedure in the case where the user selects a third utility pattern from the preferential utility pattern group. Upon operation of a preferential utility pattern group key 13, the preferential utility pattern group indication key 13A is displayed over the first and second display rows 9*a* and 9*b* on the central part of the display 9 in an enlarged size. The preferential utility pattern group indication mark 13A is displayed for 0.5 sec. and thereafter on the left end of the second display row 9*b* of the display 9 in a reduced or normal size. Subsequently, when the numeral key 14 of "3" is operated, a preferential utility pattern corresponding to pattern number "3" of the preferential utility pattern group is displayed on the first display row 9*a* of the display 9. On the other hand, when a non-used pattern number has erroneously been input, an alarming sound such as pip-pip is produced from a loud speaker incorporated as an alarming device in the sewing machine M so that the user is warned. Alternatively, an erroneous input may be displayed on the display 9 so that the user is warned.

When one of a plurality of pattern groups is selected by each of the pattern group keys 10 to 13, the control device 30 is operated so that the pattern group display data for the enlarged display indicating the selected pattern group is read from the mark memory 20*b* thereby to be displayed on the display 9 in an enlarged size. Accordingly, the user can view the pattern group indication marks 10A, 11A, 12A and 13A in an enlarged size, thereby easily grasping the selected pattern group (current pattern group selection mode). In this case, even when the screen of the display 9 is relatively smaller, each pattern group indication mark 10A, 11A, 12A and 13A is displayed in an enlarged size. Consequently, which pattern group has been selected can be displayed in such a manner that the user can easily grasp the selected pattern group.

Furthermore, each of the pattern group indication marks 10A, 11A, 12A and 13A is displayed in the enlarged size for the predetermined period of time and thereafter in the normal size. As a result, the display of each pattern group indication mark in the enlarged size can sufficiently be confirmed for the predetermined time period (about 0.5 sec.). Since each of the pattern group indication marks 10A, 11A, 12A and 13A is displayed after display of each mark in the enlarged form, the current pattern group selection mode can usually be confirmed. Furthermore, various pieces of deformation other than pattern group indication marks 10A, 11A, 12A and 13A can be prevented from being displayed. Additionally, since each of the pattern group indication marks 10A, 11A, 12A and 13A is automatically switched from the enlarged size to the normal size, the operation by the user can be prevented from being complicated.

When having been input by the number key 14, each pattern number is displayed on the display 9 in an enlarged size together with the pattern group indication marks 10A, 11A, 12A and 13A. Consequently, the user can recognize each pattern number and the pattern group indication marks 10A, 11A, 12A and 13A in the enlarged size. Accordingly, the user can easily recognize the current pattern group selection mode and the pattern number corresponding to the current pattern group selection mode.

Display of the pattern group indication marks 10A, 11A, 12A and 13A in the enlarged size is automatically switched to the display in the normal size after lapse of 0.5 sec. starting from completion of pattern number input. In this case, the sewing pattern corresponding to the pattern number is displayed on the display 9 based on the pattern display data read from the pattern display memory 20*a*. Consequently, the selected sewing pattern can be confirmed. Even in this case, the pattern group indication marks 10A, 11A, 12A and 13A are displayed in the normal size. As a result, the sewing conditions other than the pattern group indication marks 10A, 11A, 12A and 13A can be prevented from being displayed.

The pattern group indication marks 10A, 11A, 12A and 13A and each pattern number displayed in the enlarged size are similar to those displayed in the normal size. Accordingly, display can be performed without sense of discomfort for the user, whereupon the pattern group indication marks 10A, 11A, 12A and 13A and each pattern number can be understood and recognized more easily.

Modified forms of the foregoing embodiment will now be described. The pattern group indication marks 10A, 11A, 12A and 13A and each pattern number in the normal size may be enlarged at a maximum magnification over the first and second display rows 9*a* and 9*b* even when the display 9 is small in size.

When the liquid crystal display 9 is designed to perform color display, the pattern group indication marks 10A, 11A, 12A and 13A and each pattern number in the enlarged size may be colored by a color which is different from a color of the background and has a high visibility, such as red, yellow or the like. Furthermore, the pattern group indication marks 10A, 11A, 12A and 13A and each pattern number in the enlarged size may be flashed or displayed so that display locations are gradually moved.

The pattern group indication marks 10A, 11A, 12A and 13A and each pattern number are displayed in the enlarged size for the predetermined time which is 0.5 sec. However, the period of display should not be limited to 0.5 sec. The display time may be set to any value according to a level of skill of the user in sewing. Furthermore, the display time in the enlarged size may gradually be rendered shorter according to the number of times of the selected pattern group.

When the number of sewing patterns in each pattern group is large, a plurality of page pattern groups which classify the sewing patterns into a plurality of groups may be provided in lower layers of the respective pattern groups. In this case, every time the pattern group keys 10 to 13 are operated, a plurality of page pattern groups may be selected, while being cyclically switched.

The pattern group indication marks and pattern numbers may be enlarged so as to be zoomed in when switched from the normal size to the enlarged size. Alternatively, the pattern group indication marks and pattern numbers may be reduced or scaled down so as to be zoomed out when switched from the normal size to the enlarged size. Consequently, the pattern group indication marks and pattern numbers can be understood and recognized more easily.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine which carries out a sewing operation so that a sewing pattern selected from a plurality of sewing patterns is sewn, the sewing machine comprising:

a display device;

a display data storage device which stores pattern display data utilized to display each sewing pattern on the display device and pattern group display data for displaying on the display device a pattern group indication mark which is indicative of each of a plurality of pattern groups obtained by classifying the sewing patterns and numeral display data for displaying pattern numbers assigned to the respective pattern groups;

a selecting operation device which selects one of the sewing pattern groups and further selects any one of the sewing patterns contained in the selected pattern group, the selecting operation device including a number input device for inputting the pattern numbers; and a display control device which, when one of the pattern groups has been selected, causes the display device to display the pattern group indication mark indicative of the selected sewing pattern group on the display device firstly in an enlarged size and subsequently in a reduced normal size, based on the pattern group display data of the selected pattern group, wherein the display control device causes the display device to display one of the pattern numbers in an enlarged size together with the pattern group indication mark when said one of the pattern numbers has been input thereto by the number input device after selection of the pattern group.

2. The sewing machine according to claim 1, wherein the display control device controls the display device so that the pattern group indication mark is displayed in the enlarged size for a predetermined period of time and subsequently switched to the normal size.

3. The sewing machine according to claim 1, wherein the display control device controls the display device so that the enlarged size of the pattern group indication mark on display is switched to the normal size after expiration of a predetermined period of time from completion of input of the pattern number, and so that the sewing pattern corresponding to the input pattern number is displayed based on the pattern display data.

4. The sewing machine according to claim 1, wherein the display data storage device stores both normal display pattern group display data for displaying each pattern group indication mark in the normal size and enlarged display pattern group display data for displaying each pattern group indication mark in the enlarged size obtained by enlarging the normal size by a predetermined magnification ratio.

5. The sewing machine according to claim 1, wherein the display data storage device stores both numeral display data for normal display, which data is provided for displaying each pattern number in a normal size, and numeral display data for enlarged display, which data is provided for displaying each pattern number in an enlarged size obtained by enlarging the normal size by a predetermined magnification ratio.

* * * * *